US008602522B2

(12) United States Patent
Harada et al.

(10) Patent No.: US 8,602,522 B2
(45) Date of Patent: Dec. 10, 2013

(54) WASTE LIQUID CONTAINER AND LIQUID CONSUMPTION APPARATUS

(75) Inventors: Shuhei Harada, Chino (JP); Masanori Nakata, Matsumoto (JP); Taisuke Yamamoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/422,893

(22) Filed: Mar. 16, 2012

(65) Prior Publication Data

US 2012/0236074 A1 Sep. 20, 2012

(30) Foreign Application Priority Data

Mar. 18, 2011 (JP) ..... 2011-061176
Mar. 18, 2011 (JP) ..... 2011-061177
Mar. 18, 2011 (JP) ..... 2011-061178
Mar. 18, 2011 (JP) ..... 2011-061179
Mar. 18, 2011 (JP) ..... 2011-061180
Mar. 18, 2011 (JP) ..... 2011-061181
Mar. 18, 2011 (JP) ..... 2011-061182

(51) Int. Cl.
*B41J 2/165* (2006.01)
*B41J 2/185* (2006.01)

(52) U.S. Cl.
USPC ..... 347/36

(58) Field of Classification Search
USPC ..... 347/36
See application file for complete search history.

(56) References Cited

U.S. PATENT DOCUMENTS 5,642,143 A * 6/1997 Rhoads ..... 347/49
6,203,137 B1 3/2001 Niimura et al.
6,488,369 B1 * 12/2002 Steinmetz et al. ..... 347/86
6,832,830 B2 * 12/2004 Seino et al. ..... 347/86
2006/0290754 A1 * 12/2006 Nozawa et al. ..... 347/86
2008/0151019 A1 * 6/2008 Kimura et al. ..... 347/86
2008/0151020 A1 * 6/2008 Kimura et al. ..... 347/86
2008/0204530 A1 * 8/2008 Kimura et al. ..... 347/86
2008/0218568 A1 * 9/2008 Kimura et al. ..... 347/86
2009/0218270 A1 * 9/2009 Harada ..... 210/236
2009/0218271 A1 * 9/2009 Harada ..... 210/236
2009/0219337 A1 * 9/2009 Harada et al. ..... 347/36
2009/0219338 A1 * 9/2009 Harada ..... 347/36
2009/0219339 A1 * 9/2009 Harada ..... 347/36
2009/0237448 A1 * 9/2009 Kimura et al. ..... 347/36

(Continued)

FOREIGN PATENT DOCUMENTS

JP 10-119309 5/1998
JP 2006-116793 5/2006

(Continued)

*Primary Examiner* — Matthew Luu
*Assistant Examiner* — Alexander D Shenderov
(74) *Attorney, Agent, or Firm* — Workman Nydegger

(57) ABSTRACT

In a waste liquid container which is detachably mounted on a waste liquid container mounting portion including a device side connection terminal and a plate spring, the waste liquid container includes a waste liquid storing chamber which stores waste liquid, a first wall portion and a second wall portion which are disposed so as to face each other with the waste liquid storing chamber interposed therebetween, a container side connection terminal which is provided on an outer surface of the second wall portion and contacts the device side connection terminal at the time of being mounted on the waste liquid container mounting portion, and a positioning protrusion of the plate spring which is provided on the first wall portion so as to receive a biasing force which is applied from the first wall portion side toward the second wall portion side.

12 Claims, 13 Drawing Sheets

(56) References Cited

U.S. PATENT DOCUMENTS

| | | | | |
|---|---|---|---|---|
| 2009/0251512 | A1* | 10/2009 | Nozawa et al. | 347/86 |
| 2009/0256884 | A1 | 10/2009 | Aoki | |
| 2010/0091070 | A1* | 4/2010 | Kimura | 347/50 |

FOREIGN PATENT DOCUMENTS

| | | |
|---|---|---|
| JP | 2009-113345 | 5/2009 |
| JP | 2009-269204 | 11/2009 |
| JP | 2010-012652 | 1/2010 |

* cited by examiner

WASTE LIQUID CONTAINER AND LIQUID CONSUMPTION APPARATUS

CROSS REFERENCES TO RELATED APPLICATIONS

The entire disclosure of Japanese Patent Application Nos. 2011-61176, filed Mar. 18, 2011, 2011-61177, filed Mar. 18, 2011, 2011-61178, filed Mar. 18, 2011, 2011-61179, filed Mar. 18, 2011, 2011-61180, filed Mar. 18, 2011, 2011-61181, filed Mar. 18, 2011, and 2011-61182, filed Mar. 18, 2011 are expressly incorporated by reference herein.

BACKGROUND

1. Technical Field

The present invention relates to a waste liquid container for storing waste liquid such as waste ink and a liquid consumption apparatus which includes the waste liquid container.

2. Related Art

As a liquid consumption apparatus which consumes liquid by ejecting the liquid with respect to a target such as a sheet, an ink jet type printer is widely known. In the related art, in the above-described printer, there is a printer that includes a waste ink tank (waste liquid container) for storing waste ink (waste liquid) discharged from a liquid ejecting head which ejects ink (for example, JP-A-2009-269204).

A waste ink tank described in JP-A-2009-269204 is mounted in a storing chamber which is provided in a housing by being inserted from a mounting opening which is provided at the front surface side of the housing. In addition, a coil spring which biases the waste ink tank forward is provided in the inner side of the storing chamber, and a locking step which locks the waste ink tank is provided in the bottom portion of the mounting opening side of the storing chamber so as to regulate the forward movement in the waste ink tank. Moreover, the waste ink tank is pressed with respect to the locking step by the coil spring, and therefore, the waste ink tank is positioned so as not to move in the front and rear directions.

Moreover, a connection terminal (container side connection terminal) of a circuit board is provided in the waste ink tank of JP-A-2009-269204, and if the waste ink tank is mounted, the container side connection terminal contacts a device side connection terminal which is provided in the storing chamber. In addition, in a connection state where the connection terminals appropriately contact each other, various information (for example, information regarding the use start date of the waste ink tank, number of executions of cleaning, the integrated value of discharging amount of the waste ink, or the like) regarding the waste ink is sent and received between the circuit board of the waste ink tank and a control device of the printer.

However, in JP-A-2009-269204, the container side connection terminal and the device side connection terminal are disposed so as to line up in right and left directions when the waste ink tank is mounted. In addition, the waste ink tank is positioned in the front and rear directions by the coil spring at the time of being mounted, but the waste ink tank is not positioned in the right and left directions. Thereby, a separating distance between the container side connection terminal and the device side connection terminal is changed when the waste ink tank is mounted, and there is a concern that contact failure may be generated.

SUMMARY

An advantage of some aspects of the invention is to provide a waste liquid container and a liquid consumption apparatus capable of appropriately allowing a container side connection terminal and a device side connection terminal to contact each other when being mounted.

According to an aspect of the invention, there is provided a waste liquid container which is detachably mounted on a waste liquid container mounting portion including a device side connection terminal and a biasing member for positioning, including a waste liquid storing chamber which stores waste liquid, a first wall portion and a second wall portion which are disposed so as to face each other with the waste liquid storing chamber interposed therebetween, a container side connection terminal which is provided on an outer surface of the second wall portion and contacts the device side connection terminal at the time of being mounted on the waste liquid container mounting portion, and a biasing force receiving portion which is provided on the first wall portion so as to receive a biasing force of the biasing member for positioning which is applied from the first wall portion side toward the second wall portion side.

According to this configuration, since the first wall portion is positioned at the position which faces the second wall portion with the waste liquid storing chamber interposed therebetween, the biasing force receiving portion provided on the first wall portion receives the biasing force which is toward the second wall portion side. Therefore, the container side connection terminal which is provided on the second wall portion is biased toward the device side connection terminal side. Thus, the container side connection terminal can appropriately contact the device side connection terminal at the time of being mounted on the waste liquid container mounting portion.

In the waste liquid container of the aspect of the invention, the first wall portion and the second wall portion may be side walls which extend along an insertion direction of the waste liquid container with respect to the waste liquid container mounting portion.

According to this configuration, since the biasing member for positioning is an aspect which biases the waste liquid container from the first wall portion side which is the side wall extended along the insertion direction toward the second wall portion, compared to the case where the biasing member for positioning biases the waste liquid container to the extracting direction which becomes the direction opposite to the insertion direction, the load when the waste liquid container is inserted can be decreased.

In the waste liquid container of the aspect of the invention, the biasing force receiving portion may be a positioning protrusion which protrudes in a horizontal direction from an outer surface of the first wall portion.

According to this configuration, since the biasing force receiving portion is the positioning protrusion, the position which receives the biasing force is more defined than the case where the biasing force receiving portion is a plane surface, and the positioning can be performed with high accuracy.

In the waste liquid container of the aspect of the invention, the biasing member for positioning may be a plate spring which includes an extended portion extended along the insertion direction and a bending portion which is bent toward the device side connection terminal side in a tip side of the extended portion, the positioning protrusion may include a first side surface and a second side surface which extend from the first wall portion toward an apex in the protrusion direction, and the second side surface which is positioned in the front side in the insertion direction may be engaged with the bending portion of the biasing member for positioning at the time of being mounted on the waste liquid container mounting portion.

According to this configuration, since the second side surface of the positioning protrusion when the waste liquid container is mounted is engaged with the bending portion of the biasing member for positioning, the movement of the waste liquid container in the extracting direction which is the direction opposite to the insertion direction is regulated by the biasing member for positioning. Therefore, the positioning in the insertion direction of the waste liquid container can be performed by the biasing member for positioning and the positioning protrusion.

In the waste liquid container of the aspect of the invention, the waste liquid storing chamber may be formed so as to be enclosed by a storing concave portion which has an upper opening and a waste liquid container cover which covers the opening, and the biasing force receiving portion may be disposed below the first wall portion in the up and down directions.

According to this configuration, since the biasing force receiving portion is disposed at the lower portion of the first wall portion which is near to the base portion and has higher rigidity than the upper portion in which the opening is provided in the up and down directions, deformation of the first wall portion when receiving the biasing force can be suppressed.

In the waste liquid container of the aspect of the invention, the container side connection terminal and the biasing force receiving portion may be disposed so as to line up along a width direction which crosses the insertion direction with respect to the waste liquid container mounting portion.

According to this configuration, since the container side connection terminal and the biasing force receiving portion are disposed so as to line up along the width direction, the container side connection terminal can be biased toward the device side connection terminal side while suppressing the inclination of the waste liquid container due to the biasing force of the biasing force for positioning.

In the waste liquid container of the aspect of the invention, a reinforcement rib may protrude toward the second wall portion side from a position corresponding to the biasing force receiving portion in the inner surface of the first wall portion.

According to this configuration, since the reinforcement rib protrudes toward the second wall portion side from the position corresponding to the biasing force receiving portion in the inner surface of the first wall portion, deformation of the second wall portion when receiving the biasing force can be suppressed.

According to another aspect of the invention, there is provided a liquid consumption apparatus including a liquid consumption portion which consumes liquid, a waste liquid container which includes a waste liquid storing chamber for storing waste liquid which is discharged from the liquid consumption portion and a container side connection terminal, a waste container mounting portion on which the waste liquid container is detachably mounted, a device side connection terminal which is provided in the waste liquid container mounting portion so as to contact the container side connection terminal when the waste liquid container is mounted, and a biasing member for positioning which is provided in the waste liquid container mounting portion so that the waste liquid container is biased toward the device side connection terminal side when the waste liquid container is mounted.

According to this configuration, since the biasing member for positioning biases the mounted waste liquid container toward the device side connection terminal side, the container side connection terminal which is provided in the waste liquid container is biased toward the device side connection terminal side. Therefore, the container side connection terminal can appropriately contact the device side connection terminal when the waste liquid container is mounted.

According to still another aspect of the invention, there is provided a waste liquid container which is attachable and detachable to a device including a discharging portion which discharges waste liquid and can store the waste liquid which is discharged from the discharging portion in a state of being mounted on the device including a protrusion which protrudes from a side wall of the waste liquid container and is disposed lower in a vertical direction than a guide portion which is provided in the device in the state of being mounted on the device.

According to this configuration, since the protrusion is inserted from a mounting opening while being engaged so as to slide to the guide portion, the waste liquid container is not caught in the mounting opening after the insertion of the container into the mounting opening until the completion of the mounting. Therefore, a load or a mounting failure due to catching in the mounting opening at the time of the mounting can be suppressed.

In the waste liquid container of still another aspect of the invention, the protrusion may be disposed between a regulation portion and the guide portion which are provided on the device in the state of being mounted on the device.

According to this configuration, movement of the protrusion in up and down directions is regulated due to the fact that the protrusion slides between the guide portion and the regulation portion of a device side (liquid consumption apparatus side). Accordingly, inclination in the up and down directions which is generated when the waste liquid container is mounted on the device can be suppressed.

In the waste liquid container of still another aspect of the invention, the protrusion may extend along a mounting direction on the device.

According to this configuration, since the waste liquid container is guided by the protrusion which extends along the mounting direction at the time of the mounting, the waste liquid container is smoothly inserted in the mounting direction from the mounting opening and mounted.

In the waste liquid container of still another aspect of the invention, the protrusion may protrude from a side wall which is along the mounting direction of the waste liquid container.

According to this configuration, since the protrusion extends in the direction which crosses the mounting direction, the inclination at the time of the mounting in the direction which crosses the mounting direction of the waste liquid container mounted from the mounting opening can be suppressed.

In the waste liquid container of still another aspect of the invention, a functional part may be disposed on the side wall of the waste liquid container in the waste liquid container, and the protrusion may be disposed at least below the functional part.

According to this configuration, since the protrusion is engaged with the guide portion below the side wall portion in which the functional part is disposed, the waste liquid container is mounted in the state where the relative position deviation of the functional part with respect to the device is suppressed. Accordingly, when an electrical connection between the functional part and the device is performed, the connection is appropriately performed.

In the waste liquid container of still another aspect of the invention, the protrusion may be disposed at least below a biasing force receiving portion which receives a biasing force of a biasing member for positioning of the waste liquid container.

According to this configuration, since the biasing force receiving portion can be positioned in the position appropriate with respect to the biasing member for positioning, the waste liquid container can be appropriately mounted by the biasing member for positioning.

In the waste liquid container of still another aspect of the invention, in a portion which is positioned below a side wall in which the functional part is disposed or a portion which is positioned below the biasing force receiving portion, a thickness of the protrusion in up and down directions (vertical direction) may be thicker than other portions.

According to this configuration, strength of the portion which most easily receives a biasing force from the waste liquid container mounting portion in the state where the waste liquid container is mounted can be increased by the thick portion of the protrusion, and the deformation can be suppressed. In addition, since the gap in the up and down directions between the guide portion and the regulation portion can be partially decreased, the position error at the time of the mounting with respect to the waste liquid container mounting portion in the thick portion can be suppressed. Accordingly, when an electrical connection between the functional part and the device is performed, the connection is more appropriately performed.

In the waste liquid container of still another aspect of the invention, a lower surface of the protrusion may be continuous with a bottom surface of the waste liquid container.

According to this configuration, since the protrusion can be formed in a wide plane surface and the protrusion can abut with a wider area with respect to the regulating portion which is positioned below the protrusion, the waste liquid container stably slides and can be mounted.

In the waste liquid container of still another aspect of the invention, the protrusion may protrude from the side wall of the mounting direction side of the waste liquid container.

According to this configuration, since the protrusion abuts the wall surface or the like which is positioned in the inner side of the mounting opening, positioning in the insertion direction of the waste liquid container can be performed. In addition, since an end of a stopper portion in a width direction is connected to the protrusion which extends in the mounting direction, it is possible to integrally form the protrusion.

According to still another aspect of the invention, there is provided a waste liquid container which is attachable and detachable to a device including a discharging portion which discharges waste liquid and can store the waste liquid which is discharged from the discharging portion in a state of being mounted on the device, the waste liquid container includes a waste liquid storing portion which stores waste liquid discharged from the discharging portion, a base portion which extends from the waste liquid storing portion and extends from the device along an extracting direction of the waste liquid container, and a gripping portion which extends from the base portion and extends in directions other than a vertical direction among directions which cross the extracting direction.

According to this configuration, since the gripping portion extends in the directions (for example, horizontal direction) other than the vertical direction from the base portion, a user can grip the gripping portion in a state where the palm of the hand faces the directions other than up and down directions. Thereby, since a force which lifts the waste liquid container in the vertical direction, that is, upward or a force which presses the container downward can be suppressed when the waste liquid container is attached or detached, the inclination of the waste liquid container according to the attaching or the detaching can be suppressed.

In the waste liquid container of still another aspect of the invention, a surface of the base portion side of the gripping portion may be parallel to a side surface of the waste liquid storing portion in which the base portion is provided.

According to this configuration, since the gripping portion is parallel to the side surface of the waste liquid storing portion, a user can grip the gripping portion in the state where the palm of the hand is along the gap which is uniform between the gripping portion and the side surface of the waste liquid storing portion which is provided on the tip side of the gripping portion.

In the waste liquid container of still another aspect of the invention, a surface of the base portion side of the gripping portion may not be parallel to a side surface of the waste liquid storing portion in which the base portion is provided.

According to this configuration, since the surface is provided in which the gap between the surface of the gripping portion which the palm of the hand of a user abuts when the waste liquid container is extracted and the side surface of the waste liquid storing portion is not constant, the gripping portion which can be easily gripped by the user can be formed.

In the waste liquid container of still another aspect of the invention, an inclined portion, which obliquely extends toward the side surface side from the upper end side or the lower end side of the waste liquid storing portion, may be provided in the tip side in the extended direction of the gripping portions.

According to this configuration, since the inclined portion is provided in the tip side in the extended direction of the gripping portion, even in a case where the length in the up and down directions of the waste liquid storing portion or the gripping portion is not sufficient so as to cause the palm of the hand to be an exact lateral direction, the length of the gripping portion can be secured.

In the waste liquid container of still another aspect of the invention, a curved portion having a curve shape in the front surface view from the other side of the extracting direction may be provided in the tip side in the extended direction of the gripping portion.

According to this configuration, since the curved portion is provided in the tip side in the extended direction of the gripping portion, the gripping portion can be formed so as to conform to the roundness of a hand of a user.

In the waste liquid container of still another aspect of the invention, the gripping portion may extend in two directions along a horizontal direction from the base portion.

According to this configuration, since the gripping portion extends in two directions along a horizontal direction from the base portion, the gripping portion can be easily gripped by either of the right hand or the left hand.

According to still another aspect of the invention, there is provided a waste liquid container which is attachable and detachable to a device including a discharging portion which discharges waste liquid and can store the waste liquid which is discharged from the discharging portion in a state of being mounted on the device, the waste liquid container includes a waste liquid storing portion which stores the waste liquid discharged from the discharging portion, a base portion extends from the waste liquid storing portion and extends from the device along an extracting direction of the waste liquid container, and a gripping portion which extends from the base portion and extends so that a vertical direction is a longitudinal direction.

According to this configuration, since the gripping portion extends from the base portion so that the vertical direction (up and down directions) is the longitudinal direction, a user can grip the gripping portion in a state where the palm of the hand faces the horizontal direction. Thereby, for example, since the force which lifts the waste liquid container upward is suppressed when the waste liquid container is attached or detached, the inclination of the waste liquid container according to the attaching or the detaching can be suppressed.

According to still another aspect of the invention, there is provided a waste liquid container which is attachable and detachable to a device including a discharging portion which discharges waste liquid and can store the waste liquid which is discharged from the discharging portion in a state of being mounted on the device, the waste liquid container includes a waste liquid storing portion which stores the waste liquid discharged from the discharging portion, a gripping portion which extends from the waste liquid storing portion and extends from the device along an extracting direction of the waste liquid container, and in which a cross-sectional shape in a case of being cut at a surface perpendicular to the extracting direction is uniform.

According to this configuration, since the cross-sectional shape of the gripping portion of the waste liquid container in the case of being cut at the surface perpendicular to the extracting direction is uniform, the gripping portion can be easily gripped even in any direction. Therefore, the attaching or the detaching can be easily performed regardless of the installation condition of the device.

In the waste liquid container of still another aspect of the invention, up and down directions of the gripping portion may be the longitudinal direction.

According to this configuration, since the up and down directions of the gripping portion are the longitudinal direction, the gripping portion can be easily gripped in a state where the palm of the hand of a user faces a lateral direction.

In the waste liquid container of still another aspect of the invention, a shape profile of the cross-section of the gripping portion may be rectangular.

According to this configuration, since the shape profile of the cross-section of the gripping portion is rectangular, workability can be improved.

In the waste liquid container of still another aspect of the invention, a shape profile of the cross-section of the gripping portion may be circular.

According to this configuration, since the shape profile of the cross-section of the gripping portion is circular, the gripping portion can be easily gripped in any direction.

In the waste liquid container of still another aspect of the invention, a cross-sectional area of the gripping portion may be formed so as to be increased from the waste liquid storing portion side toward the tip side.

According to this configuration, since the cross-sectional area of the gripping portion is formed so as to be increased from the waste liquid storing portion side toward the tip side, the waste liquid container can be extracted by an aspect in which fingers are caught in the gripping portion.

In the waste liquid container of still another aspect of the invention, a cross-sectional area of the gripping portion may be formed so as to be uniform from the waste liquid storing portion side toward the tip side.

According to this configuration, since the cross-sectional area of the gripping portion is formed so as to be uniform from the waste liquid storing portion side toward the tip side, the method of gripping the gripping portion can be approximately constant in the extracting direction.

In the waste liquid container of still another aspect of the invention, the waste liquid container may include a storing concave portion which can store the waste liquid, and an absorption member that includes a first introducing portion which extends in the up and down directions for introducing the waste liquid and a second introducing portion which extends in the horizontal direction so as communicate with the first introducing portion in a lower portion of the storing concave portion and that is accommodated in the storing concave portion.

According to this configuration, since the waste liquid introduced into the storing concave portion through the first introducing portion is dispersed in the horizontal direction through the second introducing portion in the lower portion of the storing concave portion, the solidified waste liquid being deposited and reaching the upper portion of the first introducing portion can be delayed. In addition, even in the case where the waste liquid is solidified in the bottom portion of the second introducing portion, the waste liquid which is subsequently introduced can be absorbed by the absorption member through the side surface or the top surface of the second introducing portion. In addition, since the contact area between the waste liquid and the absorption member can be largely secured by the second introducing portion, the waste liquid can be absorbed by the absorption member with high efficiency.

In the waste liquid container of still another aspect of the invention, the absorption member may be disposed between the inner bottom surface of the storing concave portion and the second introducing portion in the up and down directions.

According to this configuration, the waste liquid which is introduced into the second introducing portion can be absorbed to the absorption member which is disposed between the inner bottom surface of the storing concave portion and the second introducing portion.

In the waste liquid container of still another aspect of the invention, the first introducing portion may communicate with the second introducing portion at the center portion in the extended direction of the second introducing portion.

According to this configuration, since the first introducing portion communicates with the second introducing portion at the center portion in the extended direction of the second introducing portion, the waste liquid which is introduced into the second introducing portion is evenly distributed in two directions along the extended direction and can be absorbed by the absorption member with high efficiency.

In the liquid consumption apparatus of another aspect of the invention, the liquid consumption apparatus may include a waste liquid introducing member, the waste liquid introducing member includes a liquid consumption portion which consumes liquid, a top plate portion which is connected to a waste liquid container including a storing concave portion to which waste liquid discharged from the liquid consumption portion is introduced and covers an opening of the storing concave portion, an introduction pipe portion which is provided so as to penetrate the top plate portion and introduces the waste liquid to the storing concave portion, and an annular protrusion which protrudes downward from the top plate portion so as to enclose a downstream side opening of the introduction pipe portion.

According to this configuration, since the downstream side opening of the introduction pipe portion is enclosed by the annular protrusion which protrudes downward, even in the case where the waste liquid which is introduced from the downstream side opening of the introduction pipe portion into the waste liquid container flows along the lower surface side of the top plate portion, the flow area can be defined as the area which is enclosed by the annular protrusion. Therefore, leakage of the waste liquid which is introduced into the waste liquid container can be suppressed.

According to still another aspect of the invention, there is provided a container holder including a mounting portion in which a liquid container storing liquid moves along insertion and extraction directions which cross a vertical direction and is mounted, a first abutment portion which abuts from the lower side in the vertical direction in one end side of the insertion and extraction directions in the liquid container mounted on the mounting portion, a second abutment portion which abuts from the lower side in the vertical direction in the other end side of the insertion and extraction directions in the liquid container mounted on the mounting portion, and a non-abutment portion which is provided between the first abutment portion and the second abutment portion and becomes a positional state which cannot abut from the lower side in the vertical direction with respect to the liquid container mounted on the mounting portion.

According to this configuration, in the liquid container which is mounted on the mounting portion, the one end side and the other end side opposite thereto in the insertion and extraction directions are abutted and supported from the lower side in the vertical direction by the first abutment portion and the second abutment portion in the container holder. Moreover, in the mounting portion at that time, the non-abutment portion which is positioned between the first abutment portion and the second abutment portion in the insertion and extraction directions does not abut the liquid container, and a gap in the vertical direction is secured between the non-abutment portion and the liquid container. Thereby, even in a case where the mounting portion is formed of materials in which bending is easily generated, a concern in which a convex portion formed so that the apex is convex according to occurrence of the bending contacts from the lower side in the liquid container can be decreased, and an unintentional inclination of the liquid container having the convex portion as the supporting point can be suppressed. Therefore, even in the case where the bending is generated in the mounting portion, since the convex portion according to the bending is formed in the non-abutment portion in which the gap is secured between the convex portion and the liquid container, the contact between the convex portion and the liquid container is suppressed and the liquid container can be appropriately mounted. That is, the liquid container can be appropriately mounted on the mounting portion at the time of the mounting, and the mounting failure due to the inclination of the liquid container which is continuously mounted on the mounting portion even after mounting the container can be suppressed.

In the container holder of still another aspect of the invention, the first abutment portion may be formed in a position which supports a side opposite to the side to which the liquid container is previously inserted into the mounting portion when the liquid container is mounted on the mounting portion in the insertion and extraction directions of the liquid container mounted on the mounting portion.

According to this configuration, in the container holder, since the first abutment portion is formed in a position so as to support the end of the one end side in the insertion and extraction directions of the liquid container mounted on the mounting portion, that is, the end of the side opposite to the side to which the liquid container is previously inserted into the mounting portion when the liquid container is mounted on the mounting portion, compared to the case where the first abutment is formed so as to support the portion of the other end side in the insertion and extraction directions rather than the end portion, the area which can suppress the contact between the convex portion and the liquid container can be widened in the insertion and extraction directions. Therefore, an unintentional inclination of the liquid container can be further suppressed in the case where the bending is generated in the mounting portion.

According to still another aspect of the invention, there is provided a liquid ejecting apparatus including a liquid ejecting head which ejects liquid with respect to a target, a transport device which transports the target, a waste liquid container mounting portion which detachably mounts the waste liquid container for storing waste liquid discharged from the liquid ejecting head, a housing in which a mounting opening for mounting the waste liquid container is provided, and a cover which is attached to the housing so as to be opened and closed, configures a portion of the transport device in the closed state, and covers at least a portion of the mounting opening.

According to this configuration, since the cover configures a portion of the transport device in the closed state, the transport operation of the target and the ejecting operation of the liquid are stopped when the cover is opened. Thereby, since the configuration which separately detects that the mounting opening is opened is not needed, it is possible to simplify a configuration of the apparatus. In addition, since the cover configuring any portion of the transport device is preferable, the degree of freedom when disposing the component can be secured.

In the liquid ejecting apparatus of still another aspect of the invention, the waste liquid container may include a gripping portion which is gripped when the waste liquid container is attached and detached and the cover may cover the gripping portion when the cover is closed.

According to this configuration, since it is preferable if the gripping portion is covered when the cover is closed, the cover can be miniaturized compared to the case of covering the entire mounting opening.

In the liquid ejecting apparatus of still another aspect of the invention, the cover may configure a portion of the transport path for transporting the target.

According to this configuration, since the cover configures a portion of the transport path, the cover is not required to be electrically connected to a power source for transporting the target, or the like. Therefore, the installation structure with respect to the housing of the cover can be simplified.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
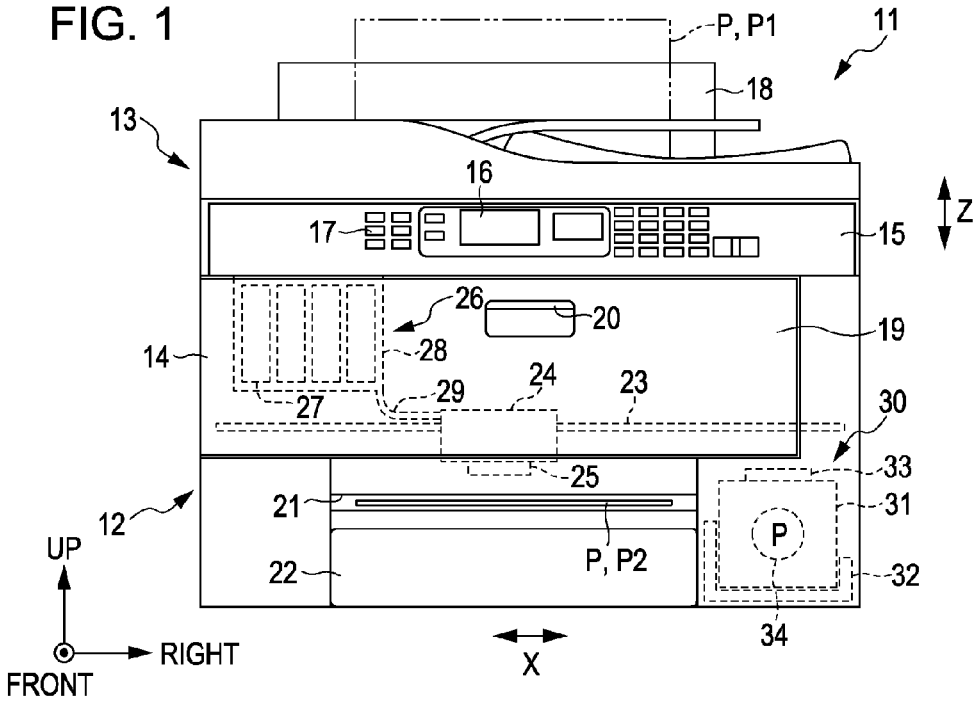
FIG. 1 is a front view showing an embodiment of a multifunction machine of the invention.

Hereinafter, an embodiment which embodies the invention as a multifunction machine having a function of an ink jet type printer will be described with reference to drawings. In descriptions below, "front and rear directions", "right and left directions", and "up and down directions" each indicate the "front and rear direction", the "right and left directions", and the "up and down directions" which are shown by arrows in each drawing. In addition, in arrows which indicate an upper direction, a right direction, and a front direction in drawings, an arrow (the view when the tip of the arrow is viewed from the front) in which a point is depicted in a circle means the arrow which is from the rear of the drawing toward the front thereof, and an arrow (the view when the feathers of the arrow are viewed from the rear) in which a cross is depicted in a circle means the arrow which is from the front of the drawing toward the rear thereof. In addition, the up and down directions becomes a vertical direction.

As shown in FIG. 1, in a multifunction machine 11, a recording portion 12 which functions as an ink jet type printer, which is an example of an ink ejecting apparatus and a liquid consumption apparatus, and an image reading portion 13 which functions as an image reading apparatus are disposed so as to line up in the up and down directions, and are integrally combined.

The recording portion 12 includes a recording portion case 14 which configures a portion of a housing. A control panel 15 for operating the recording portion 12 and the image reading portion 13 is disposed in the upper portion of the front surface side in the recording portion case 14. The control panel 15 includes a display portion 16 (for example, a liquid crystal display) for displaying a menu screen or the like, and operating portions 17 which are provided in both the right side and left side of the display portion 16. In addition, a manual tray 18 for manually feeding sheets P (P1) which is a target is provided in the rear surface side of the recording portion case 14.

A front surface cover 19 is mounted so as to be opened and closed in the lower portion of the control panel 15 in the recording portion case 14. In addition, a front surface side gripping portion 20 is concavely provided in the front surface cover 19 on which users put their hands when opening and closing the front surface cover 19. In addition, a sheet discharging port 21 is opened below the front surface cover 19 in the recording portion case 14. Moreover, a sheet feeding cassette 22 which can store a plurality of sheets P (P2) in a laminated state is detachably mounted below the sheet discharging port 21 in the recording portion case 14.

A guide shaft 23 which extends along a main scanning direction X (right and left directions in the embodiment) is disposed in the recording portion case 14. In addition, a carriage 24 is supported to the guide shaft 23 in a state of being capable of moving along the main scanning direction X.

The carriage 24 is reciprocated along the main scanning direction X according to driving of a carriage motor (not shown). In addition, a liquid ejecting head 25, which is a liquid consumption portion consuming liquid by ejecting ink, which is an example of the liquid, with respect to sheets P and performing a record (print) processing and which is an example of a discharging portion which discharges the liquid, is supported to the lower surface side of the carriage 24.

A liquid supply mechanism 26 for supplying the ink to the liquid ejecting head 25 is disposed in a first end side (left end side in the embodiment) of a movement region along the main scanning direction X of the carriage 24. The liquid supply mechanism 26 includes a cartridge holder 28 for detachably mounting a plurality of (four in the embodiment) ink cartridges 27 which store ink, and an ink supply tube 29 for supplying ink from the cartridge holder 28 side toward the carriage 24 side. In addition, the ink cartridges 27 are attached to and detached from the cartridge holder 28 in a state in which the front surface cover 19 of the recording portion case 14 is opened.

A maintenance device 30 for performing maintenance of the liquid ejecting head 25 is disposed in a second end side (right end side in the embodiment) of the movement region along the main scanning direction X of the carriage 24. The maintenance device 30 includes a waste liquid container 31 for storing waste liquid such as waste ink which is discharged from the liquid ejecting head 25, and a waste liquid container mounting portion 32 for detachably mounting the waste liquid container 31. In addition, the maintenance device 30 includes a waste liquid introducing member 33 for introducing the waste liquid, which is discharged from the liquid ejecting head 25, to the waste liquid container 31, and a suction pump 34 for discharging the waste liquid from within the liquid ejecting head 25 by suction.

Figure 2:
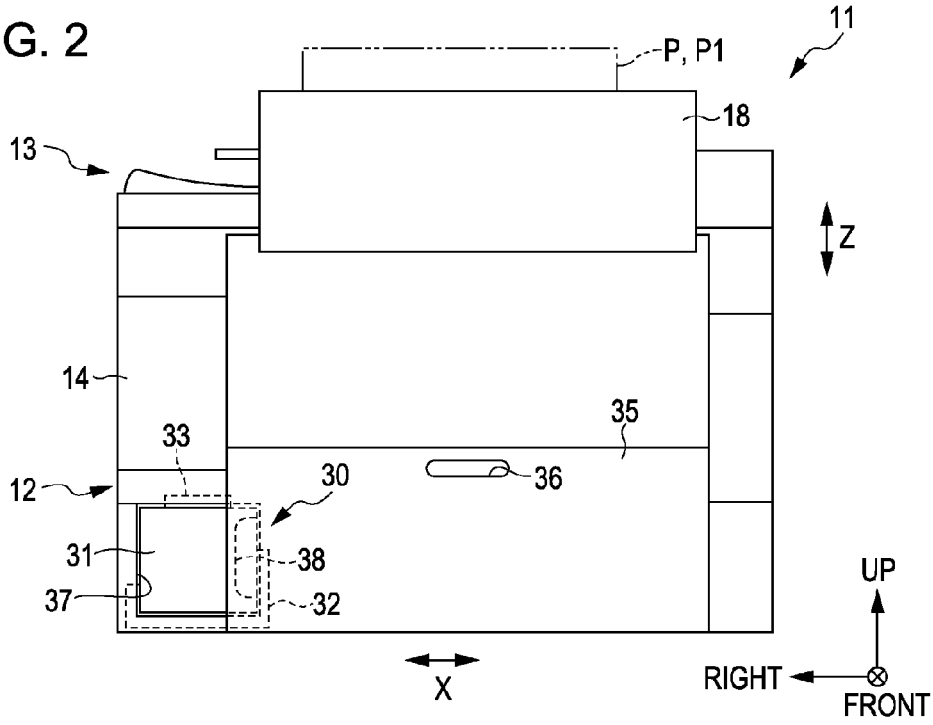
FIG. 2 is a rear view showing the multifunction machine of FIG. 1.

As shown in FIG. 2, a rear surface cover 35 is mounted so as to be opened and closed in the lower portion of the rear surface side in the recording portion case 14. In addition, a rear surface side gripping portion 36 is concavely provided in the rear surface cover 35 on which users put their hands when opening and closing the rear surface cover 35.

In addition, a mounting opening 37 for mounting the waste liquid container 31 is opened in the lower right in the rear surface side of the recording portion case 14. Moreover, a gripping portion 38 which is gripped at the time of the mounting and detaching is provided in the waste liquid container 31. The rear surface cover 35 in the closed state covers a portion of the left end side of the mounting opening 37 and the gripping portion 38 of the waste liquid container 31 which is mounted through the mounting opening 37. In addition, in a case where the waste liquid container 31 is exchanged, or the like, after the used waste liquid container 31 is extracted from the mounting opening 37 which is opened by opening the rear surface cover 35, an unused waste liquid container 31 is mounted on the waste liquid container mounting portion 32 by being inserted from the same mounting opening 37.

Figure 3:
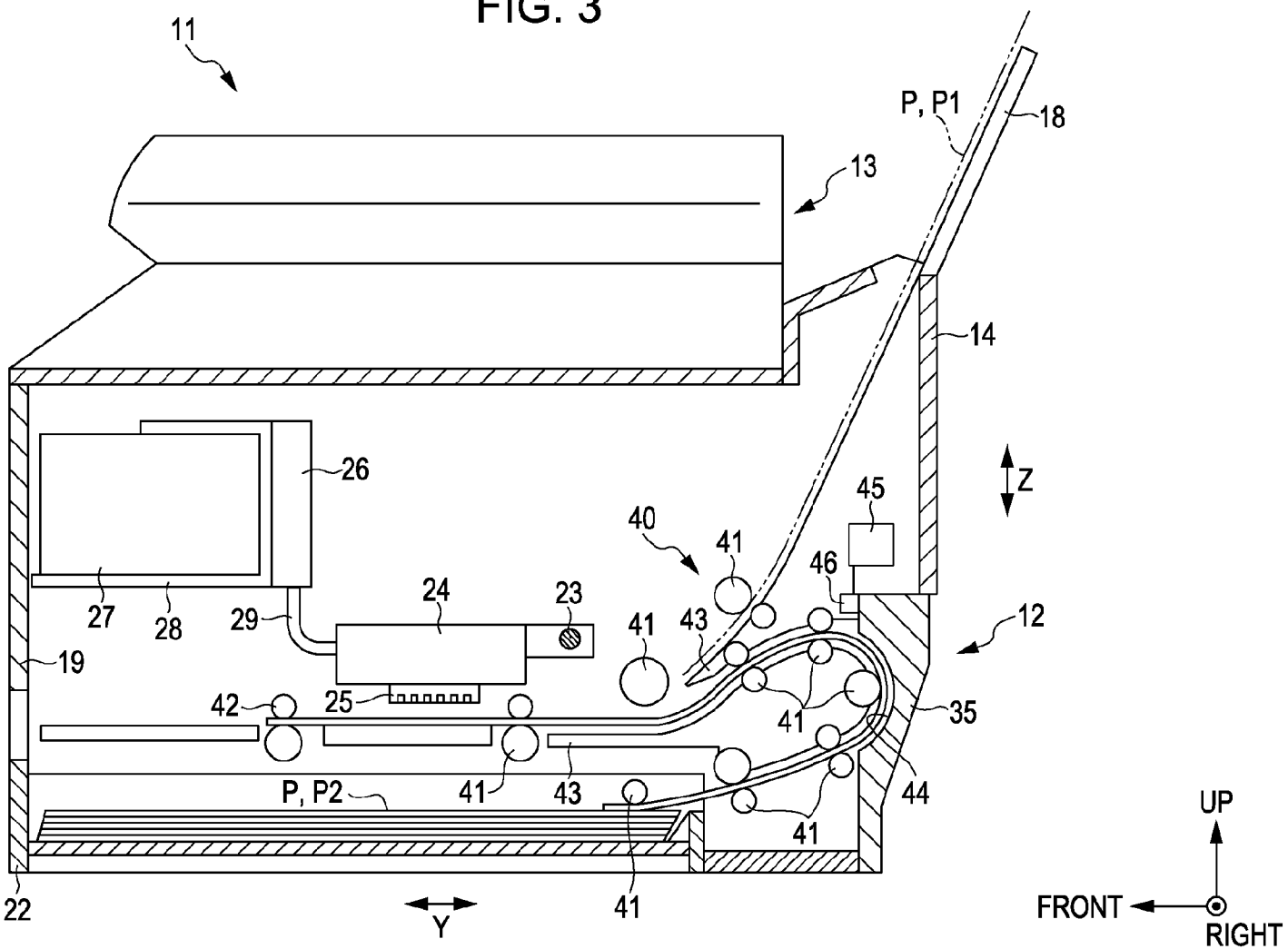
FIG. 3 is a cross-sectional view showing the multifunction machine of FIG. 1.

As shown in FIG. 3, a transport device 40 for transporting the sheets P is accommodated in the recording portion case 14. The transport device 40 includes a sheet feeding roller 41 for feeding the sheets P to the liquid ejecting head 25 side, a sheet discharging roller 42 for discharging the sheets P which perform the recording, and a transport path forming member 43 which forms the transport path of the sheets P.

In addition, after the sheets P2 which are fed from the sheet feeding cassette 22 are reversed behind the liquid ejecting head 25, the sheets are fed toward the front. Moreover, the front side portion of the rear surface cover 35 becomes a reversal path forming portion 44 for reversing the sheets P2. That is, the rear surface cover 35 in the closed state configures a portion of the transport device 40 by configuring a portion of the transport path for transporting the sheets P.

In addition, since a portion of the transport path is opened in the case where the rear surface cover 35 is opened, when the sheets P2 are jammed or the like, maintenance such as removal of the jammed sheets P2 is performed by opening the rear surface cover 35.

A control device 45 for controlling the operation of the multifunction machine 11 and a detection sensor 46 for detecting the opening and closing states of the rear surface cover 35 are accommodated in the recording portion case 14. Moreover, when the detection sensor 46 detects that the rear surface cover 35 reaches an opened state, the control device 45 controls the recording portion 12 and stops the recording processing, and controls the transport device 40 and stops the transport processing of the sheets P.

Next, a configuration of the waste liquid container mounting portion 32 will be described in detail.

Figure 4:
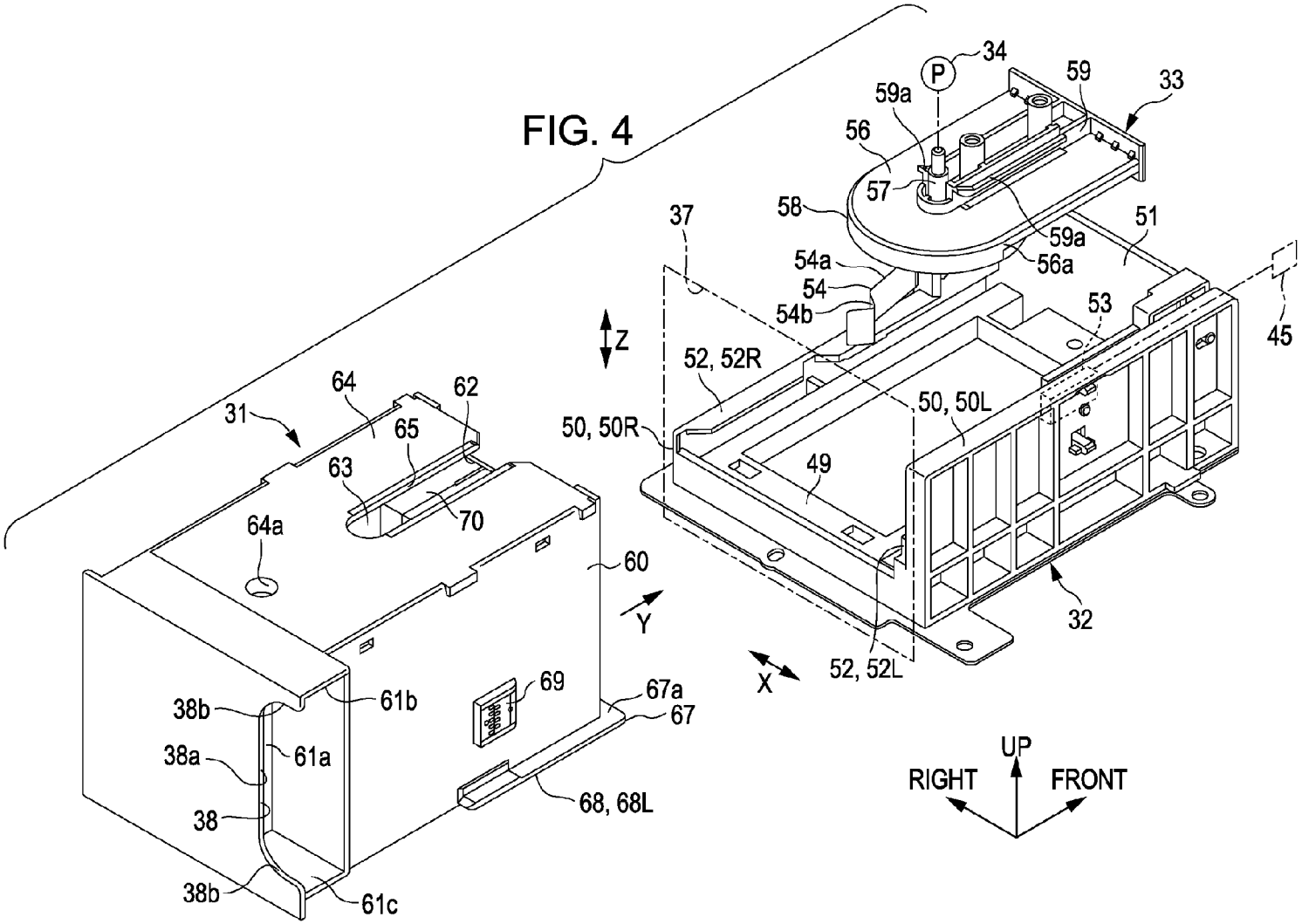
FIG. 4 is a perspective view showing a waste liquid container mounting portion, a waste liquid introducing member, and a waste liquid container.

As shown in FIG. 4, the waste liquid container mounting portion 32 includes a bottom surface portion 49 which supports the waste liquid container 31, side walls 50 (right side wall 50R and left side wall 50L) which extend along the up and down directions Z and the insertion direction Y from the mounting opening 37, and a front side wall 51 which extends in the up and down directions Z and the main scanning direction X so as to cross (perpendicular) to the right side wall 50R and the left side wall 50L. In addition, the right side wall 50R and the left side wall 50L are parallel to each other and erected so as to face each other while interposing the bottom surface portion 49.

In the inner side surfaces of the right side wall 50R and the left side wall 50L which face each other, guide portions 52 (52R and 52L) which extend along a mounting direction (insertion direction Y) which is from the mounting opening 37 toward the inner side of the waste liquid container mounting portion 32 are provided. The guide portion 52R is configured of a rib which protrudes from the right side wall 50R toward the left, and the guide portion 52L is configured of a rib which protrudes from the left side wall 50L toward the right.

A device side connection terminal 53 for receiving information with respect to the waste liquid or the like from the waste liquid container 31 side is mounted near the center in the insertion direction Y in the right surface side of the left side wall 50L. In addition, the device side connection terminal 53 is electrically connected to the control device 45. Moreover, the device side connection terminal 53 outputs the information, which is received from the device side connection terminal 53, to the control device 45.

A base end side of a plate spring 54, which is an example of a biasing member for positioning, is fixed in the inner side in the inserting directing Y of the right side wall 50R. The plate spring 54 includes an extended portion 54*a* which extends along the insertion direction Y from the inner side toward the front side in the insertion direction Y, and a bending portion 54*b* which is bent toward the device side connection terminal 53 side in the tip side of the extended portion 54*a*.

The waste liquid introducing member 33, which is connected to the waste liquid container 31 for introducing the waste liquid suctioned by the suction pump 34 to the waste liquid container 31, is disposed above the waste liquid container mounting portion 32. The waste liquid introducing member 33 is disposed in the inner side of the waste liquid container mounting portion 32 in the insertion direction Y.

Figure 5:
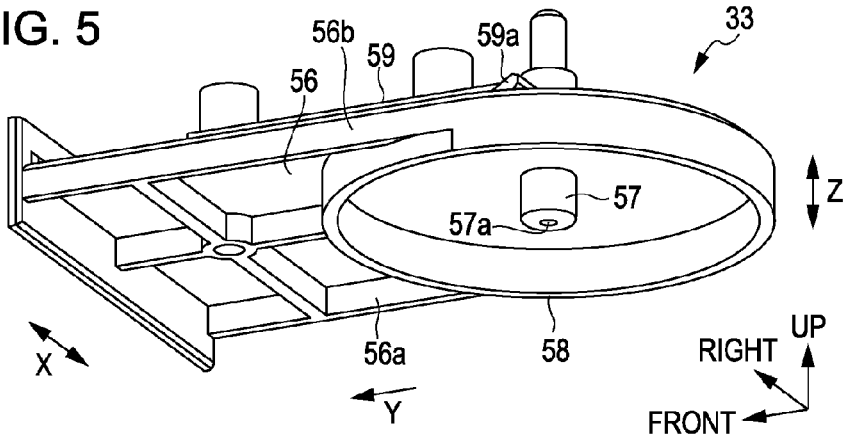
FIG. 5 is a perspective view showing the waste liquid introducing member.

The waste liquid introducing member 33 includes a plate-like top plate portion 56 which extends in a horizontal direction, an introduction pipe portion 57 which is provided in a manner to penetrate the top plate portion 56, an annular protrusion 58 which protrudes downward from the top plate portion 56, a fitting portion 59 which protrudes upward from the top plate portion 56, and a pressing portion 59*a* which protrudes in the main scanning direction X (right and left directions) from the tip side of the fitting portion 59. In addition, as shown in FIG. 5, the downstream side portion of the introduction pipe portion 57 protrudes downward from the lower surface side of the top plate portion 56. In addition, the introduction pipe portion 57 is provided so as to enclose a downstream side opening 57*a* of the introduction pipe portion 57.

In the end in at least the left direction (both right and left directions in the embodiment) of the top plate portion 56, a protruding portion 56*a* (and protruding portion 56*b* (refer to FIG. 5)) which protrudes downward from the top plate portion 56 is provided in a band shape along the outer shape of the top plate portion 56. Moreover, in the embodiment, the protruding portion 56*a* (56*b*) extends along the outer shape in the insertion direction Y from the annular protrusion 58 up to a position which overlaps with at least a container side connection terminal 69 described below in the front and rear directions.

Next, a configuration of the waste liquid container 31 will be described.

As shown in FIG. 4, the waste liquid container 31 includes a waste liquid storing portion 60 for storing the waste liquid, a base portion 61*a* which extends from the waste liquid storing portion 60 toward the front side (rearward) along the insertion direction Y, that is, extends along the extracting direction, and a plate-like gripping portion 38 which extends in a horizontal direction (the left direction in the embodiment) from the base portion 61*a*.

A straight line portion 38*a*, which extends in the up and down directions Z so as to have a gap parallel to the side surface of the waste liquid storing portion 60, is provided in the tip side in the extended direction of the gripping portion 38. In addition, a curved portion 38*b* is provided so as to have a curve shape in the front surface view from the other side in the extracting direction, that is, from the front side in the insertion direction Y in the upper end side and the lower end side of the straight line portion 38*a*.

In addition, a plate-like base portion 61*b* extends along the horizontal direction and the insertion direction Y from the upper end side of the waste liquid storing portion 60 toward the front side in the insertion direction Y, and a plate-like base portion 61*c* parallel to the base portion 61*b* extends from the lower end side of the waste liquid storing portion 60 toward the front side in the insertion direction Y. In addition, since each of the base portions 61*b* and 61*c* is connected to the upper end and the lower end of the gripping portion 38, the gripping portion 38 extends so that the up and down directions Z from the base portions 61*b* and 61*c* are the longitudinal direction.

Moreover, the waste liquid storing portion 60 includes a storing concave portion 62 which is opened upward, and a waste liquid container cover 64 which is formed so as to enclose the waste liquid storing chamber 63, which stores the waste liquid, by covering a portion of an opening of the storing concave portion 62.

In the inner side in the insertion direction Y of the waste liquid container cover 64, a notch 65 which can fit to the fitting portion 59 of the waste liquid introducing member 33 is formed so as to extend along the insertion direction Y. That is, the fitting portion 59 is formed according to the shape of the notch 65. Moreover, an air hole 64*a* for adjusting an amount of evaporation of the waste liquid stored in the storing concave portion 62 is formed in the rear side which becomes the front side in the insertion direction Y of the notch 65 in the waste liquid container cover 64.

Figure 6:
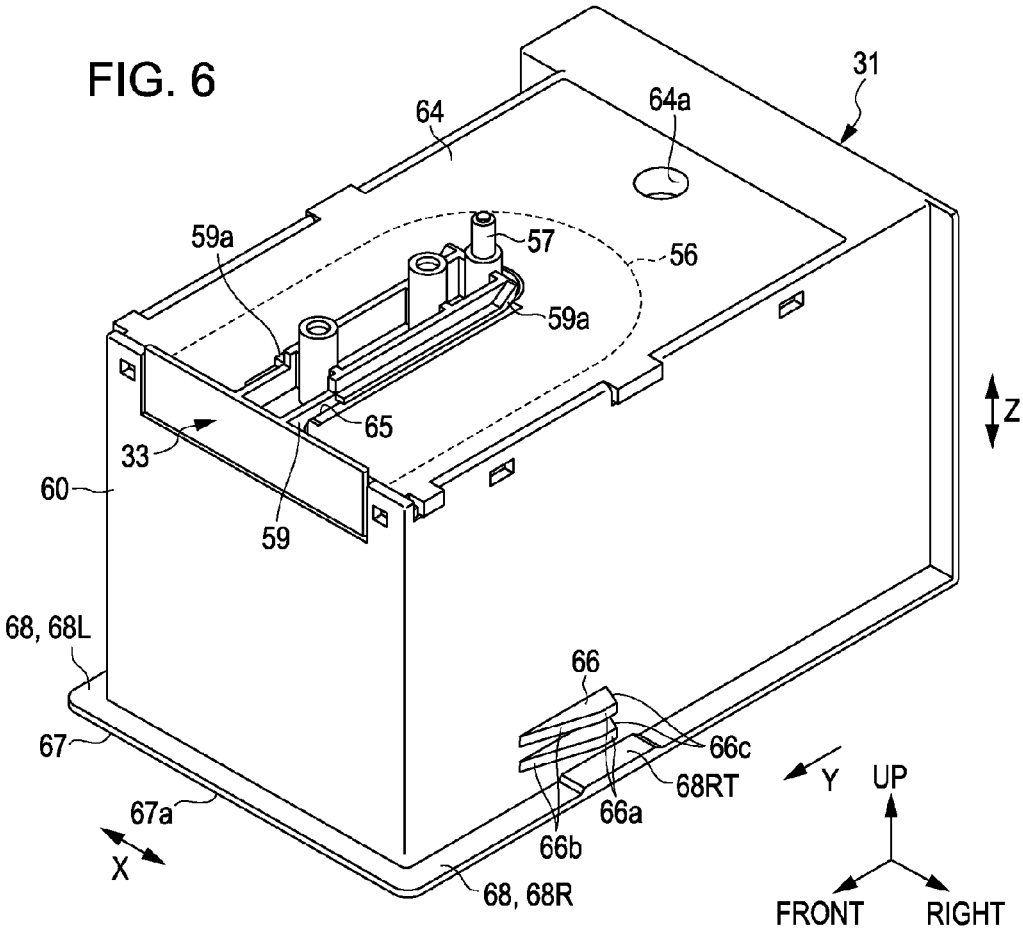
FIG. 6 is a perspective view showing the waste liquid introducing member and the waste liquid container.

As shown in FIG. 6, the waste liquid introducing member 33 is connected to the waste liquid container 31 due to the fact that the fitting portion 59 is fitted to the notch 65 of the waste liquid container cover 64 according to the insertion of the waste liquid container 31. At this time, since the waste liquid container cover 64 is inserted so as to be interposed between the pressing portion 59*a* and the top plate portion 56 of the waste liquid introducing member 33, movement in the up and down directions Z of the waste liquid container cover 64 is regulated. Moreover, in FIGS. 6, 11, and 12, the illustration of the waste liquid container mounting portion 32 is omitted in order to describe the configuration of the waste liquid container 31.

A positioning protrusion 66, which is an example of a biasing force receiving portion, protrudes in the horizontal direction on the right side surface of the waste liquid storing portion 60. Moreover, the positioning protrusion 66 is disposed in the lower portion of the waste liquid storing portion 60 in the up and down directions Z. The positioning protrusion 66 includes a first planar side surface 66*b* and a second planar side surface 66*c* which extend from the right side surface of the waste liquid storing portion 60 toward an apex 66*a* in the protrusion direction. In addition, the second side surface 66*c* is disposed further forward from the apex 66*a* in the insertion direction Y while the first side surface 66*b* is disposed further inside than the apex 66*a* in the insertion direction Y.

A positioning rib 67 which is a protrusion protrudes in the horizontal direction from the lower end portion of the waste liquid storing portion 60. The positioning rib 67 includes an engagement portion 68 (68R and 68L) which protrudes so as to be a portion of a protrusion from the side surface extended along the insertion direction Y of the waste liquid storing portion 60 toward the width direction (the main scanning direction X perpendicular to the insertion direction Y and the up and down directions Z), and a stopper portion 67*a* which protrudes so as to be a portion of a protrusion from the side surface (front surface) which becomes the inner side in the insertion direction Y of the waste liquid storing portion 60. In addition, the second engagement portion 68L protrudes leftward from the left surface of the waste liquid storing portion 60 while the first engagement portion 68R protrudes rightward from the right surface of the waste liquid storing portion 60.

The first engagement portion 68R and the second engagement portion 68L extend along the insertion direction Y from the front end side which becomes the inner side in the insertion direction Y toward the rear end side which becomes the front side in the insertion direction Y. In addition, the end portion of the stopper portion 67*a* in the width direction (main scanning direction X) is connected to the first engagement portion 68R and the second engagement portion 68L. Moreover, the first engagement portion 68R extends from the front end side to the rear end side in the insertion direction Y of the waste liquid container 31. In this way, the first engagement portion 68R is disposed at least below the positioning protrusion 66 of the waste liquid container 31. In addition, in the portion of the first engagement portion 68R which is positioned below the positioning protrusion 66, a thick portion 68RT in which the thickness in the up and down directions Z is thicker compared to that of other portions is formed.

Figure 7:
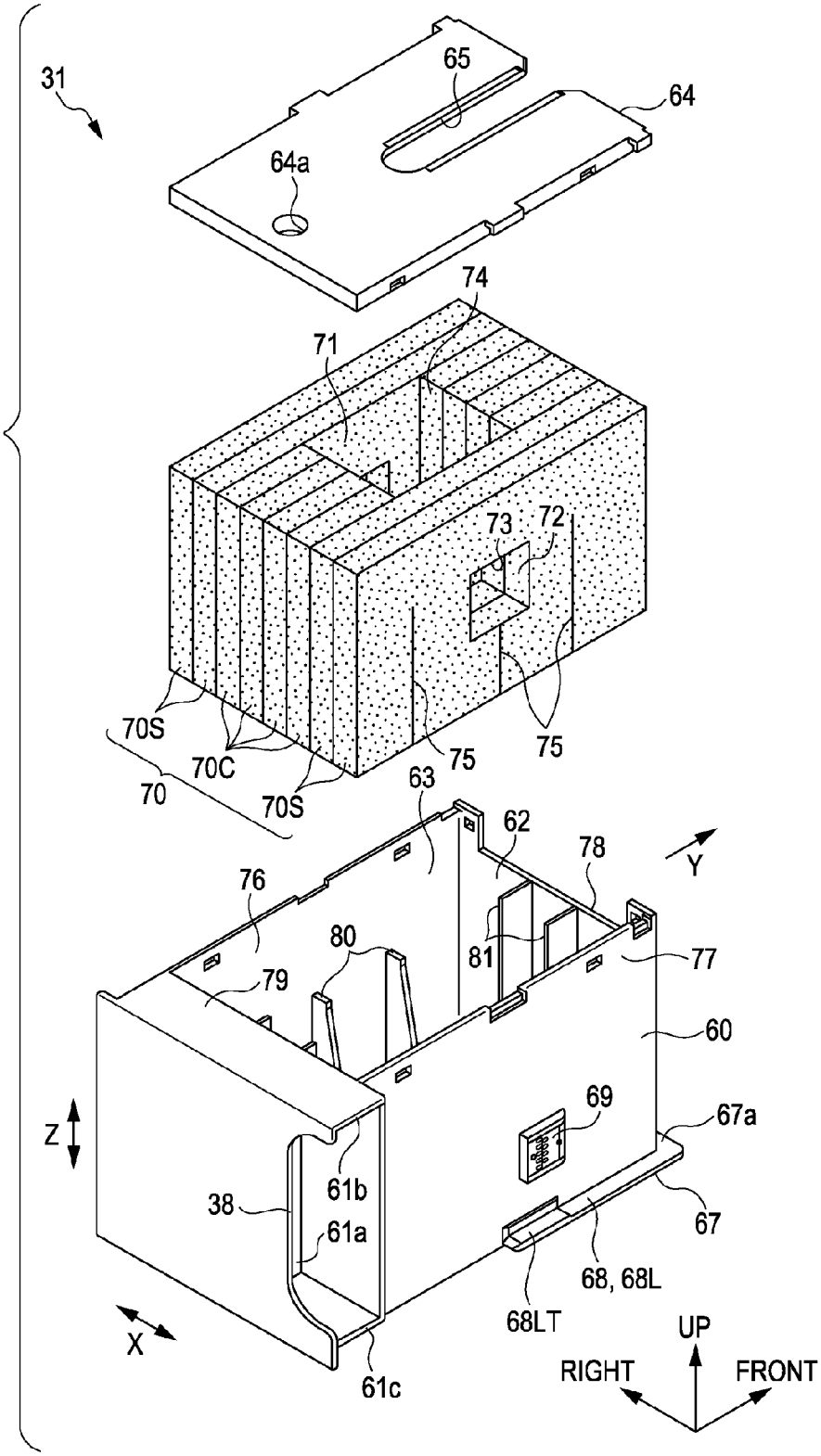
FIG. 7 is an exploded perspective view showing the waste liquid container.

As shown in FIG. 7, the container side connection terminal 69 of a circuit board (not shown) which stores various information regarding a capacity of the waste liquid container 31 or the like is attached on the left side surface of the waste liquid storing portion 60 as an example of functional parts. In addition, the second engagement 68L extends from the front end side of the waste liquid container 31 to near the center at which the container side connection terminal 69 is provided in the insertion direction Y. Moreover, the functional parts are not limited to the connection terminal (circuit board), and may include electronic parts (semiconductor or the like) or mechanism elements.

An absorption member 70 for absorbing the waste liquid is accommodated in the storing concave portion 62. The absorption member 70 includes a first introducing portion and a second introducing portion for introducing the waste liquid. That is, a vertical hole 71 which extends in the up and down directions Z is formed as the first introducing portion, and a horizontal hole 72 which extends in a horizontal direction so as to communicate with the vertical hole 71 in the lower portion of the storing concave portion 62 is formed as the second introducing portion. In addition, in the embodiment, the main scanning direction X becomes the extended direction of the horizontal hole 72. Moreover, the opening area of the vertical hole 71 is formed so as to be greater than that of the horizontal hole 72, and the vertical hole 71 communicates with the horizontal hole 72 in a center portion in the extended direction of the horizontal hole 72.

The absorption member 70 is accommodated in the storing concave portion 62 in a state where a plurality of (eight in the embodiment) plate-like absorption members 70S and 70C are laminated in the main scanning direction X. Through holes 73 each of which forms the horizontal hole 72 are provided in the two absorption members 70S which are disposed in both end sides in the main scanning direction X. In addition, through holes 74 each of which forms a vertical hole 71 communicating with the horizontal hole 72 are provided in four absorption members 70C which are disposed in the center in the main scanning direction X so as be interposed between the absorption members 70S. Thereby, the absorption member 70 is disposed between the inner bottom surface of the storing concave portion 62 and the horizontal hole 72 in the up and down directions Z. Moreover, each of three incisions 75 is formed in the absorption members 70S so as to extend upward from the lower end side and be lined up along the insertion direction Y.

The waste liquid storing portion 60 includes a first wall portion 76 which is a right side wall and extends along the insertion direction Y and the up and down directions Z, and a second wall portion 77 which is disposed so as to face the first wall portion 76 while interposing the waste liquid storing chamber 63 and is a left side wall so as to be parallel to the first wall portion 76. Moreover, the waste liquid storing portion 60 includes a third wall portion 78 which is a front side wall and extends in the main scanning direction X and the up and down directions Z, and a fourth wall portion 79 which is disposed so as to face the third wall portion 78 while interposing the waste liquid storing chamber 63, and is a rear side wall and parallel to the third wall portion 78.

In addition, the left side surface of the first wall portion 76, the right side surface of the second wall portion 77, the rear side surface of the third wall portion 78, and the front side surface of the fourth wall portion 79 form the inner surface of the storing concave portion 62. In addition, the first engagement portion 68R (refer to FIG. 6) and the positioning protrusion 66 (refer to FIG. 6) are provided on the right side surface which becomes the outer surface of the first wall portion 76, and the second engagement portion 68L and the container side connection terminal 69 are provided on the left side surface which becomes the outer surface of the second wall portion 77. Moreover, the stopper portion 67*a* is provided on the front side surface which becomes the outer surface of the third wall portion 78. In addition, the second engagement portion 68L extends rearward from the front end side in the insertion direction Y in the waste liquid storing portion 60 so as to be disposed at least below the container side connection terminal 69. In addition, in the portion of the second engagement portion 68L which is positioned below the container side connection terminal 69, the thick portion 68LT in which the thickness in the up and down directions Z is thicker compared to that of other portions is formed.

Three plate-like reinforcement ribs 80 each protrude so as to be toward the inside of the waste liquid storing chamber 63 and extend upward from the lower end side and be lined up along the insertion direction Y each in the left side surface of the first wall portion 76 and the right side surface of the second wall portion 77. In addition, two plate-like regulation ribs 81 each extend along the up and down directions Z from the lower end side to the upper end side toward inside the waste liquid storing chamber 63 and protrude so as to line up along the main scanning direction X each in the rear side surface of the third wall portion 78 and the front side surface of the fourth wall portion 79.

Due to the fact that the reinforcement ribs 80 are inserted between the incisions 75 formed on the absorption member 70S, the movement in the insertion direction Y of the absorption member 70 is regulated. Moreover, due to the fact that the regulation ribs 81 are inserted between the adjacent two absorption members 70C, the movement in the main scanning direction X of the absorption member 70 is regulated.

Next, operation of the multifunction machine 11 (particularly, waste liquid container 31 and waste liquid container mounting portion 32) will be described.

First, when the waste liquid container 31 is exchanged, a user opens the rear surface cover 35 which is provided on the rear surface side of the multifunction machine 11. At this time, it is preferable to stop the recording processing in advance. However, even in case where the recording processing is not stopped, the control device 45 stops the driving of the recording portion 12 and the transport device 40 if the detection sensor 46 detects that the rear surface cover 35 reaches an opened state.

In addition, if the rear surface cover 35 reaches an opened state, since the gripping portion 38 of the waste liquid container 31 which is mounted on the waste liquid container mounting portion 32 is exposed, the user grips the gripping portion 38 in a state where the palm of the hand is a horizontal direction (the left direction in the embodiment). Moreover, after the user extracts the used waste liquid container 31 through the mounting opening 37 in the rear direction which becomes the extracting direction, the user similarly grips the gripping portion 38 of an unused waste liquid container 31 and inserts the container in the insertion direction Y from the mounting opening 37. Therefore, the container is mounted on the waste liquid container mounting portion 32.

In addition, if the rear surface cover 35 is closed after the waste liquid container 31 is mounted, since the gripping portion 38 of the waste liquid container 31 is covered by the rear surface cover 35, easy removal is suppressed at the time of the mounting. In addition, since the rear surface cover 35 is not closed if the waste liquid container 31 is not securely inserted, that the liquid container 31 is securely mounted is confirmed even in a Power OFF state in which the detection sensor 46 is not operated by closing the rear surface cover 35.

On the other hand, since a portion of the waste liquid container 31 and the mounting opening 37 is not covered by the rear surface cover 35 and is exposed, the user can easily observe the positions of the waste liquid container 31 and the mounting opening 37. In addition, since the rear surface cover 35 does not need to cover the entire opening of the mounting opening 37, increase in the size of the rear surface cover is suppressed.

Figure 8:
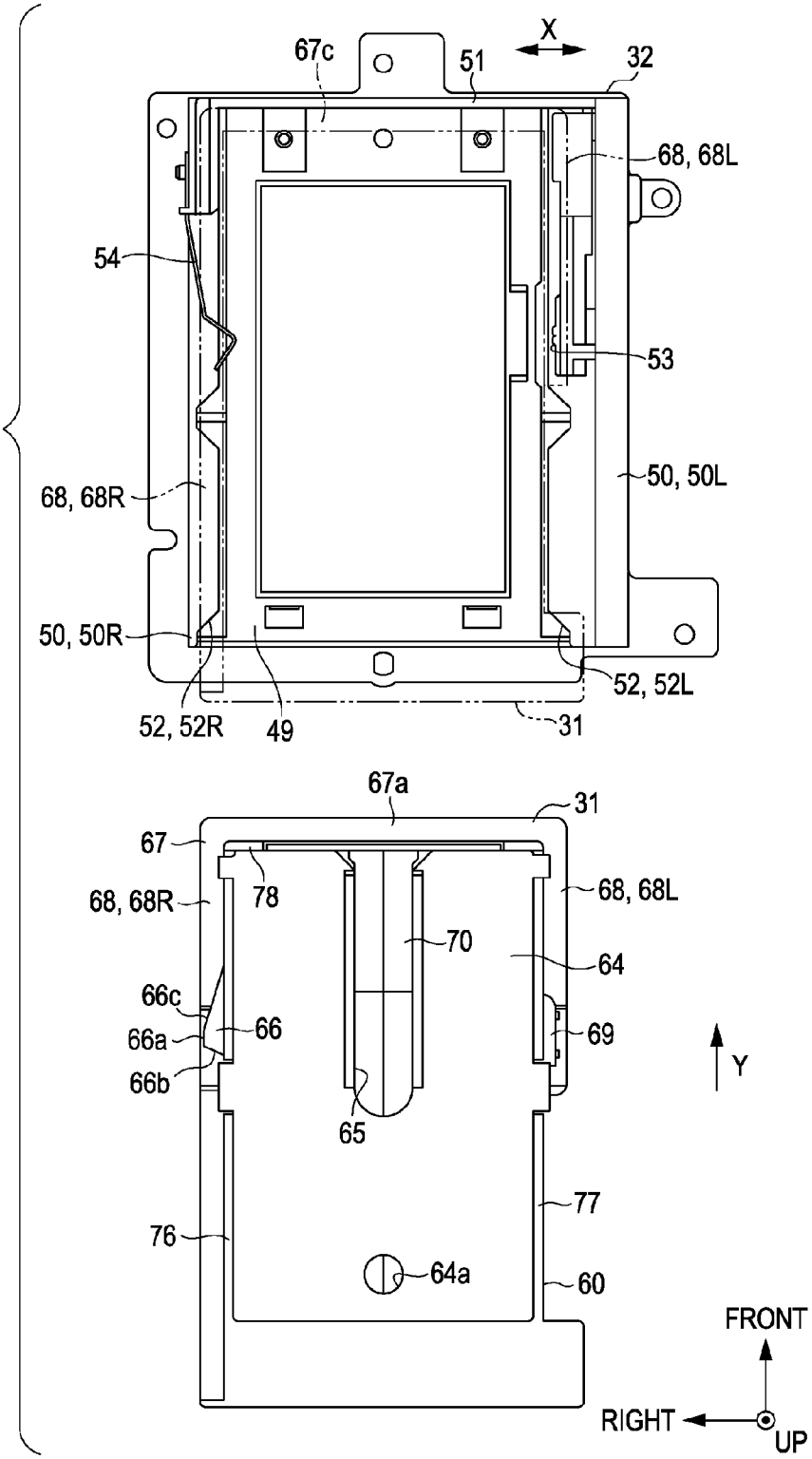
FIG. 8 is a top view for explaining an operation of the waste liquid container mounting portion and the waste liquid container.

Moreover, when the waste liquid container 31 is inserted into the waste liquid container mounting portion 32, as shown by a two-dot chain line in FIG. 8, the engagement portion 68 which is provided in the waste liquid container 31 is engaged so as to slide with the lower surface of the guide portion 52 of the waste liquid container mounting portion 32 in the insertion direction Y. Thereby, since the engagement portion 68 is disposed between the bottom surface portion 49 of the waste liquid container mounting portion 32 and the guide portion 52, the waste liquid container 31 is inserted in the insertion direction Y in the state of being positioned in up and down directions Z. Accordingly, the bottom surface portion 49 functions as a regulation portion in the downward direction. Moreover, since the waste liquid container 31 reaches the inner side of the waste liquid container mounting portion 32 and the stopper portion 67*a* abuts the front side wall 51, the positioning of the waste liquid container in the insertion direction Y is achieved. In addition, in FIG. 8, the illustration of the waste liquid introducing member 33 is omitted in order to describe the configuration of the waste liquid container mounting portion 32.

Figure 9:
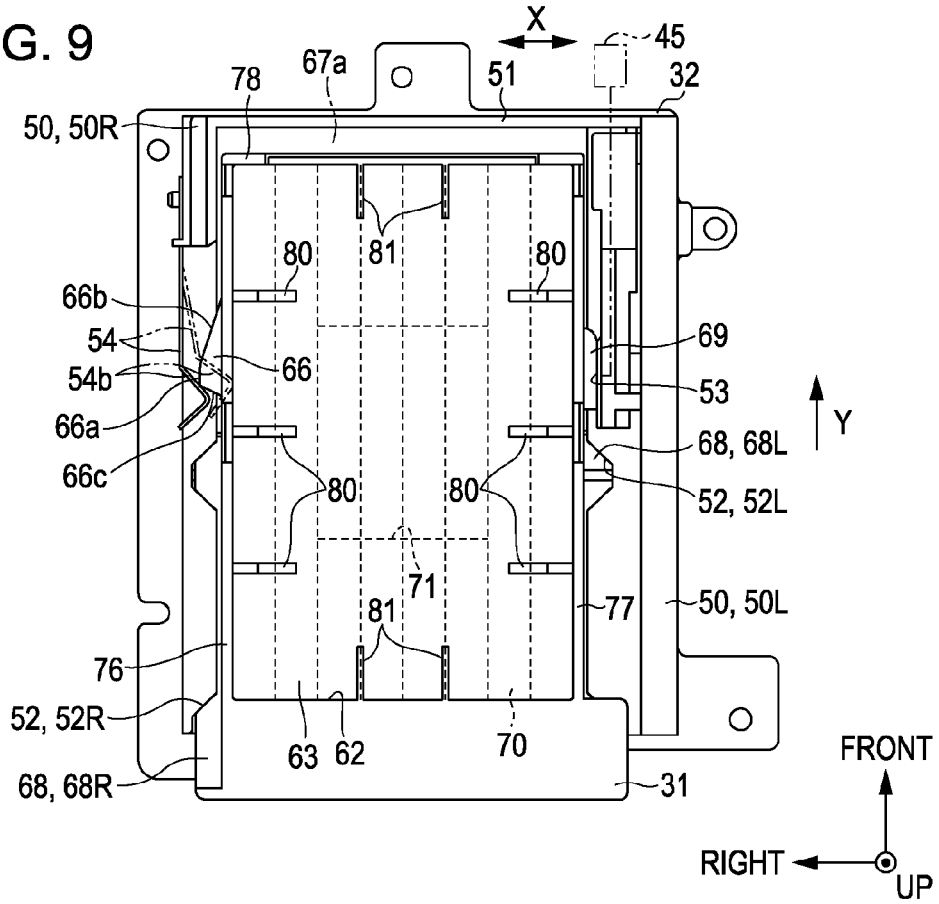
FIG. 9 is a top view for explaining an operation of the waste liquid container mounting portion and the waste liquid container.

Moreover, after the bending portion 54*b* of the plate spring, which is positioned in a position indicated by a two-dot chain line in FIG. 9 before the waste liquid container 31 is inserted, gets over the first side surface 66*b* and the apex 66*a* of the positioning protrusion 66 according to the insertion of the waste liquid container 31, the bending portion 54*b* is engaged with the second side surface 66*c* as shown by a solid line in FIG. 9.

Thereby, the movement in the extracting direction (rearward) of the waste liquid container 31 is regulated, and the waste liquid container is biased toward the left side wall 50L side on which the device side connection terminal 53 of the waste liquid container mounting portion 32 is provided. At this time, the positioning protrusion 66 of the waste liquid container 31 receives the basing force which is toward the second wall portion 77 side from the first wall portion 76 side of the plate spring 54. In addition, since the reinforcement ribs 80 protrude toward the second wall portion 77 side in the position corresponding to the position protrusion 66 in the left side surface which becomes the inner surface of the first wall portion 76, deformation of the first wall portion 76 is suppressed even in a case where the positioning protrusion 66 receives the biasing force of the plate spring 54. Moreover, in FIG. 9, in order to describe the position of the reinforcement ribs 80, the illustrations of the waste liquid introducing member 33 and the waste liquid container cover 64 are omitted and the absorption member 70 is indicated by a dotted line.

In addition, the container side connection terminal 69 and the positioning protrusion 66 are disposed so as to line up along the main scanning direction X (width direction) in the waste liquid container 31; if the mounting of the waste liquid container 31 is completed, the container side connection terminal 69 which is provided on the outer surface of the second wall portion 77 contacts the device side connection terminal 53 in the state of being positioned to the terminal. Moreover, in this way, due to the fact that the container side connection terminal 69 is appropriately connected to the device side connection terminal 53, various information (for example, information regarding the use start date of the waste ink tank 27, number of executions of cleaning, the integrated value of discharging amount of the waste ink, or the like) regarding the waste ink is sent and received between the circuit board and the control device 45 of the waste liquid container 31 side.

Figure 10:
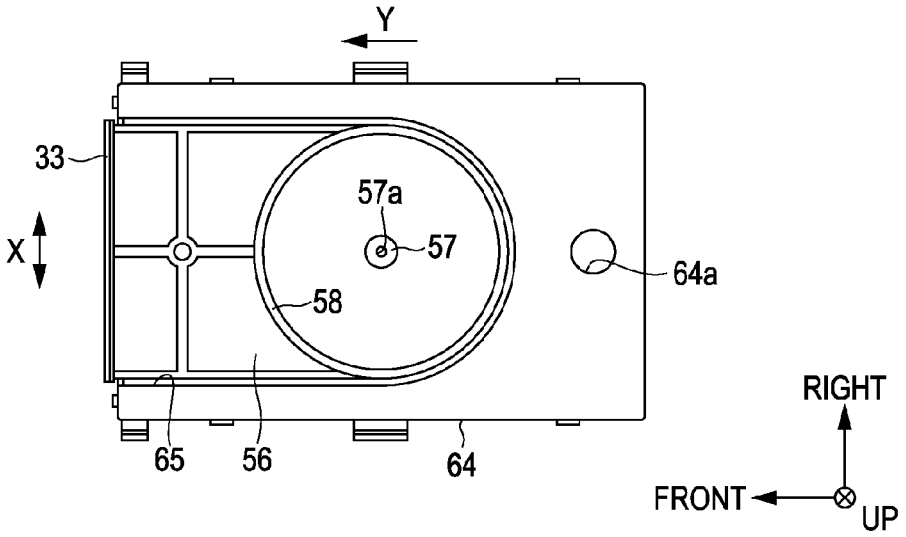
FIG. 10 is a bottom view showing a waste liquid container cover and the waste liquid introducing member.
Figure 11:
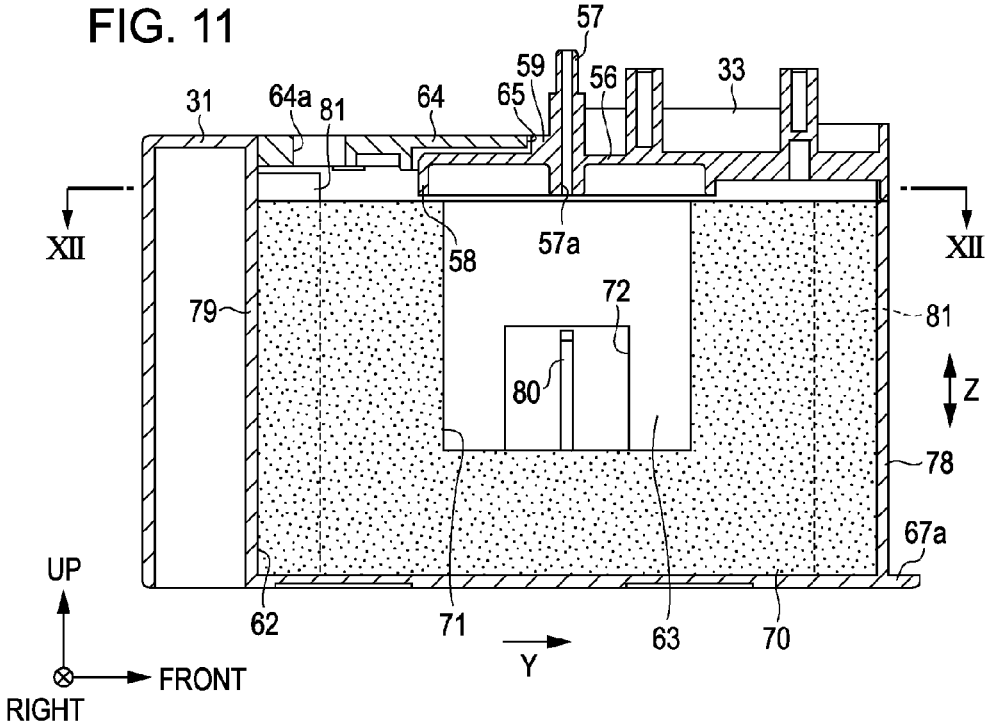
FIG. 11 is a cross-sectional view for explaining the operation of the waste liquid introducing member and the waste liquid container.

In addition, according to the insertion of the waste liquid container 31 to the waste liquid container mounting portion 32, as shown in FIG. 10, the waste liquid introducing member 33 is connected to the waste liquid container cover 64 of the waste liquid container 31. Thereby, as shown in FIG. 11, since the top plate portion 56 of the liquid introducing member 33 and the waste liquid container cover 64 cooperatively cover the storing concave portion 62 of the waste liquid container 31, the top plate portion and the waste liquid container cover are formed so as to enclose the waste liquid storing chamber 63 and configure a portion of ceiling of the waste liquid storing chamber 63.

Moreover, when the waste liquid introducing member 33 is connected to the waste liquid container 31, the lower end of the annular protrusion 58 is disposed between the waste liquid container cover 64 and the absorption member 70 in the up and down directions Z. Therefore, the waste liquid which flows from the downstream side opening 57*a* of the introduction pipe portion 57 to the annular protrusion 58 side is promptly absorbed by the absorption member 70.

Figure 12:
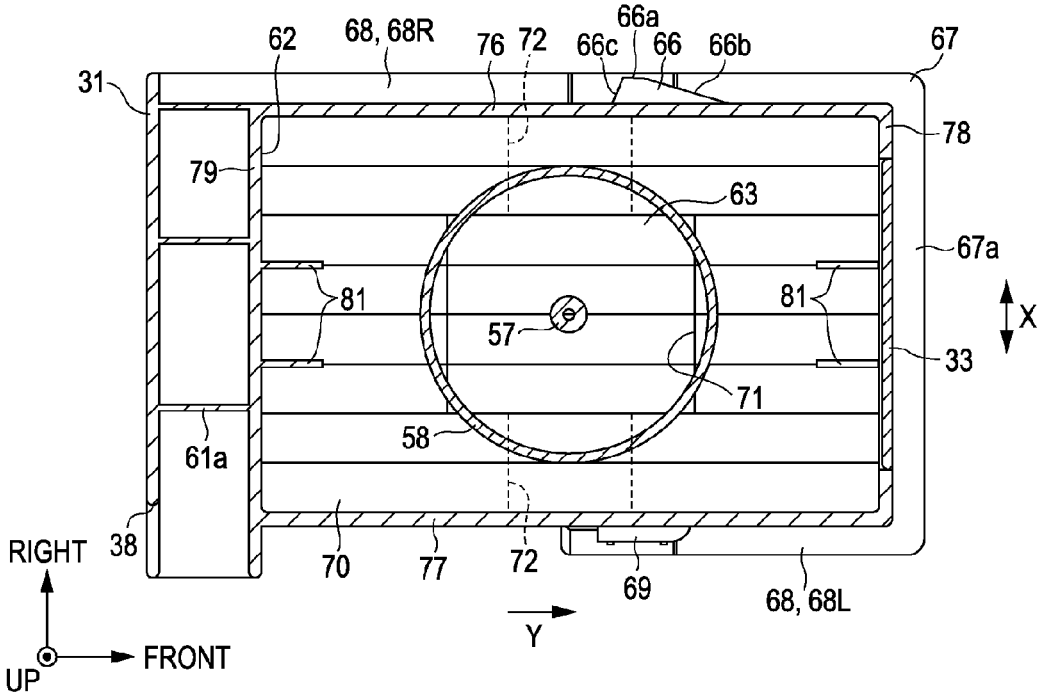
FIG. 12 is a cross-sectional view taken along a line XII-XII in FIG. 11.

In addition, when the waste liquid container 31 is mounted, as shown in FIG. 12, the introduction pipe portion 57 of the waste liquid introducing member 33 is disposed near the center of the vertical hole 71 in plan view. Therefore, if the waste liquid is introduced into the waste liquid storing chamber 63 through the introduction pipe portion 57, the introduced waste liquid flows into the horizontal hole 72 through the vertical hole 71. Thereby, since the contact area between the waste liquid and the absorption member 70 is largely secured by the vertical hole 71 and the horizontal hole 72, the waste liquid is promptly absorbed by the absorption member 70.

Moreover, in the introduced waste liquid, a solute component such as a pigment is solidified due to drying and deposits are generated. However, wider storage space for the deposits are secured by the horizontal hole 72 which communicates with the vertical hole 71. In addition, due to the fact that the introduced waste liquid flows into the horizontal hole 72, since the contact area between the waste liquid and the absorption member 70 which is disposed on the bottom portion of the waste liquid is widely secured, the waste liquid is promptly absorbed by the absorption member 70 before being solidified.

According to the embodiment, the following effects can be obtained.

(1) Since the downstream side opening 57*a* of the introduction pipe portion 57 is enclosed by the annular protrusion 58 which protrudes downward, even in the case where the waste liquid which is introduced from the downstream side opening 57*a* of the introduction pipe portion 57 into the waste liquid container 31 flows along the lower surface side of the top plate portion 56, the flow area can be defined as the area which is enclosed by the annular protrusion 58. Therefore, leakage of the waste liquid which is introduced into the waste liquid container 31 can be suppressed.

(2) Since the waste liquid introducing member 33 is connected to the waste liquid container 31 due to the fact that the fitting portion 59 is fitted to the notch 65 of the waste liquid container cover 64, a gap which is generated between the waste liquid container cover 64 and the waste liquid introducing member 33 is eliminated, and leakage of the waste liquid can be suppressed. In addition, since the waste liquid introducing member 33 is connected to the waste liquid container 31 according to the insertion of the waste liquid container 31, a separate operation which connects the waste liquid introducing member 33 is not required. Therefore, an operation which attaches and detaches the waste liquid container 31 can be simplified.

(3) Since the fitting portion 59 protrudes upward from the top plate portion 56, the waste liquid container cover 64 which is fitted to the fitting portion 59 is disposed higher than the annular protrusion 58. Therefore, the waste liquid which is discharged from the downstream side opening 57*a* of the introduction pipe portion 57 is suppressed from flowing into the waste liquid container cover 64 side along the fitting portion 59.

(4) Since the lower end of the annular protrusion 58 is disposed between the waste liquid container cover 64 and the absorption member 70 in the up and down directions Z, the waste liquid which flows along the annular protrusion 58 from the downstream side opening 57*a* of the introduction pipe portion 57 can be promptly absorbed by the absorption member 70.

(5) When the waste liquid flows from the area which is enclosed by the annular protrusion 58 to the outside in the top plate portion 56, the waste liquid which flows along the lower surface of the top plate portion 56 can be accumulated at the protruding portion 56*a* (56*b*) which extends in a strip. Accordingly, since the waste liquid can be suppressed from flowing to the side wall of the waste liquid container 31 along the top plate portion 56, for example, an electrical connection between the container side connection terminal 69 of the circuit board which is disposed on the wall surface of the left side wall of the waste liquid storing portion 60 which is the side wall of the waste liquid container 31 and the device side connection terminal 53 can be appropriately performed.

(6) The lower end of the annular protrusion 58 which protrudes downward from the top plate portion 56 is disposed within the waste liquid storing chamber 63, and the waste liquid container cover 64 which is fitted to the fitting portion 59 is disposed higher than the annular protrusion 58. Moreover, since the downstream side opening 57*a* of the introduction pipe portion 57 is enclosed by the annular protrusion 58 which protrudes downward, even in the state where the waste liquid which is introduced from the downstream side opening 57*a* of the introduction pipe portion 57 into the waste liquid container 31 flows along the lower surface side of the top plate portion 56, the flow area can be defined as the area which is enclosed by the annular protrusion 58. In addition, since the waste liquid introducing member 33 is connected to the waste liquid container 31 due to the fact that the fitting portion 59 is fitted to the notch 65 of the waste liquid container cover 64, a gap which is generated between the waste liquid introducing member 33 and the waste liquid container cover 64 is eliminated, and leakage of the waste liquid can be suppressed. Therefore, the waste liquid which is discharged from the downstream side opening 57*a* of the introduction pipe portion 57 is suppressed from flowing along the waste liquid container cover 64 side, and leakage of the waste liquid which is introduced into the waste liquid container 31 can be suppressed.

(7) Since the rear surface cover 35 configures a portion of the transport device 40 in the state of being closed, the transport operation of the sheets P and ejecting operation of the ink are stopped when the rear surface cover 35 is opened. Thereby, since the configuration which separately detects that the mounting opening 37 is opened may not be adopted, it is possible to simplify configuration of the apparatus. In addition, since the rear surface cover 35 configuring any portion of the transport device 40 is preferable, the degree of freedom when disposing the component can be secured.

(8) Since the gripping portion 38 may be covered in the state where the rear surface cover 35 is closed, the rear surface cover 35 can be miniaturized compared to the case of covering the entire mounting opening 37.

(9) Since the rear surface cover 35 configures a portion of the transport path, the rear surface cover is not required to be electrically connected to a power source for transporting the sheets P, or the like. Therefore, the installation structure with respect to the recording portion case 14 of the rear surface cover 35 can be simplified.

(10) Maintenance of the transport path can be performed by opening the transport path in the state where the rear surface cover 35 is opened.

(11) Since the rear surface cover 35 is provided on the rear surface side of the recording portion case 14, easy removal of the waste liquid container 31 from the front surface side of the apparatus by user can be suppressed.

(12) Since the first wall portion 76 is disposed so as to face the second wall portion 77 while interposing the waste liquid storing chamber 63, the positioning protrusion 66 which is provided on the first wall portion 76 receives the biasing force toward the second wall portion 77 side. Therefore, the container side connection terminal 69 provided on the second wall portion 77 is biased toward the device side connection terminal 53 side. Thereby, the container side connection terminal 69 can appropriately contact the device side connection terminal 53 when the waste liquid container 31 is mounted on the waste liquid container mounting portion 32.

(13) Since the plate spring 54 biases the waste liquid container 31 from the first wall portion 76 side which is the side wall extended along the insertion direction Y toward the second wall portion 77, compared to the case where the plate spring 54 biases the waste liquid container 31 to the extracting direction which becomes the direction opposite to the insertion direction Y, the load when inserting the waste liquid container 31 can be decreased.

(14) Since the biasing force receiving portion is constituted of the positioning protrusion 66, the position which receives the biasing force is further defined rather than the case where the biasing force receiving portion is constituted of a plane surface, and it is possible to position the waste liquid container with high accuracy.

(15) Since the second side surface 66*c* of the positioning protrusion 66 is engaged with the bending portion 54*b* of the plate spring 54 when the waste liquid container 31 is mounted, the movement of the waste liquid container 31 to the extracting direction which becomes the direction opposite to the insertion direction Y is regulated by the plate spring 54. Therefore, the positioning in the insertion direction Y of the waste liquid container 31 can be performed by the plate spring 54 and the positioning protrusion 66.

(16) Since the positioning protrusion 66 is disposed at the lower portion of the first wall portion 76 which is near to the base portion of the storing concave portion 62 and has higher rigidity than the upper portion in which the opening of the storing concave portion 62 is provided in the up and down directions Z, deformation of the first wall portion 76 when receiving the biasing force can be suppressed.

(17) Since the container side connection terminal 69 and the positioning protrusion 66 are disposed so as to line up along the width direction (main scanning direction X), the container side connection terminal 69 can be biased toward the device side connection terminal 53 side while inclination of the waste liquid container 31 is suppressed by the biasing force of the plate spring 54.

(18) Since the reinforcement ribs 80 protrude from the position corresponding to the positioning protrusion 66 in the inner surface of the first wall portion 76 toward the second wall portion 77 side, deformation of the second wall portion 77 when receiving the biasing force can be suppressed.

(19) Since the plate spring 54 biases the mounted waste liquid container 31 toward the device side connection terminal 53 side, the container side connection terminal 69 which is provided on the waste liquid container 31 is biased toward the device side connection terminal 53 side. Therefore, the container side connection terminal 69 appropriately contacts the device side connection terminal 53 when the waste liquid container 31 is mounted.

(20) Since the waste liquid container 31 is inserted from the mounting opening 37 while the engagement portion 68 is engaged so as to slide with the guide portion 52, catching of the waste liquid container in the mounting opening 37 or the like is not generated from the insertion of the mounting opening 37 to the completion of the mounting. Therefore, the load due to catching in the mounting opening 37 or the like at the time of mounting can be suppressed.

(21) Since the first engagement portion 68R and the second engagement portion 68L which are each provided on the first wall portion 76 and the second wall portion 77 which are parallel to each other are engaged with the guide portion 52 of the recording portion 12 side, inclination in the up and down directions Z when the waste liquid container 31 is mounted can be suppressed.

(22) Since the first engagement portion 68R and the second engagement portion 68L extend along the insertion direction Y which is the mounting direction, the engagement portions are engaged with the guide portion 52 which extends along the insertion direction Y from the mounting opening 37. Therefore, the inclination in the insertion direction Y when the waste liquid container 31 is mounted can be suppressed.

(23) Since the engagement portion 68 extends in the direction which crosses the mounting direction, the inclination at the time of mounting in the direction which crosses the mounting direction of the waste liquid container 31 which is mounted on the mounting opening can be suppressed.

(24) Since the engagement portion 68 is engaged with the guide portion 52 in the lower portion of the second wall 77 to which the container side connection terminal 69 is disposed, the waste liquid container is mounted in the state where the relative position deviation of the container side connection terminal 69 with respect to the recording portion 12 is suppressed. Therefore, when electrical connection which becomes the functional operation between the container side connection terminal 69 which is a functional part and the recording portion 12 is performed, appropriate electrical connection is performed.

(25) Since the positioning protrusion 66 can be positioned at the appropriate position with respect to the plate spring 54, the waste liquid container 31 can be appropriately mounted by the plate spring 54.

(26) The waste liquid container smoothly slides in the mounting direction due to the thicker portion of the engagement portion 68, and the gap between the guide portion 52 and the bottom surface portion 49 in the up and down directions can be decreased.

(27) Since the engagement portion 68 can be formed in a wide plane surface, the engagement portion 68 can abut the bottom surface portion 49 with a wider area with respect to the bottom surface portion 49 which is positioned below the engagement portion 68. Therefore, the waste liquid container 31 stably slides and can be mounted.

(28) Since the stopper portion 67*a* of the positioning rib 67 abuts the front side wall 51 which is positioned in the inner side of the mounting opening 37, the positioning in the insertion direction Y of the waste liquid container 31 can be performed. In addition, since the end of the stopper portion 67*a* in the width direction (main scanning direction X) is connected to the first engagement portion 68R and the second engagement portion 68L, the positioning rib 67 can be integrally formed.

(29) Since the gripping portion 38 extends from the base portion 61*a* in the horizontal direction among the directions other than the vertical direction, a user can grip the gripping portion 38 in the state where the palm of the hand is toward the horizontal direction. Thereby, since the force which lifts the waste liquid container 31 when the waste liquid container 31 is attached and detached is suppressed, the inclination of the waste liquid container 31 according to the attaching and detaching can be suppressed.

(30) Since the gripping portion 38 is parallel to the side surface of the waste liquid storing portion 60, a user can grip the gripping portion 38 in the state where the palm of the hand is along the gap which is uniform between the gripping portion and the side surface of the waste liquid storing portion which is provided on the tip side of the gripping portion 38. Alternatively, since the surface is provided in which the gap between the surface of the gripping portion 38 which the palm of the hand of a user abuts when the waste liquid container 31 is extracted and the side surface of the waste liquid storing portion 60 is not constant, the gripping portion 38 which can be easily gripped by the user can be formed.

(31) Since the curved portion 38*b* is provided in the tip side in the extended direction of the gripping portion 38, the gripping portion 38 can be formed so as to conform to the roundness of a hand of a user.

(32) Since the gripping portion 38 extends so that the up and down directions Z from the base portions 61*b* and 61*c* are the longitudinal direction, a user can grip the gripping portion 38 in the state where the palm of the hand faces a horizontal direction. Thereby, since the force which lifts the waste liquid container 31 when the waste liquid container 31 is attached and detached is suppressed, the inclination of the waste liquid container 31 according to the attaching and detaching can be suppressed.

(33) Since the waste liquid which is introduced into the storing concave portion 62 through the vertical hole 71 is dispersed in a horizontal direction through the horizontal hole 72 in the lower portion of the storing concave portion 62, the solidified waste liquid being deposited and reaching the upper portion of the vertical hole 71 can be delayed. In addition, even in the case where the waste liquid is solidified in the bottom portion of the horizontal hole 72, the waste liquid which is subsequently introduced can be absorbed by the absorption member 70 through the side surface or the top surface of the horizontal hole 72. In addition, since the contact area between the waste liquid and the absorption member 70 can be largely secured by the horizontal hole 72, the waste liquid can be absorbed by the absorption member 70 with high efficiency.

(34) The waste liquid which is introduced into the horizontal hole 72 can be absorbed by the absorption member 70 which is disposed between the inner bottom surface of the storing concave portion 62 and the horizontal hole 72.

(35) Since the vertical hole 71 communicates with the horizontal hole 72 at the center portion in the extended direction of the horizontal hole 72, the waste liquid which is introduced into the horizontal hole 72 is evenly distributed in two directions along the extended direction and can be absorbed by the absorption member 70 with high efficiency.

(36) Since the absorption member 70 is formed in a plate shape and stored in the storing concave portion 62 while having the aspect which is laminated in the extended direction of the horizontal hole 72, workability when forming the vertical hole 71 and the horizontal hole 72 can be improved.

(37) Since the waste liquid container 31 is connected to the waste liquid introducing member 33 according to the insertion of the container, operation which connects the waste liquid introducing member 33 is not separately required. Therefore, the attaching and detaching operation of the waste liquid container 31 can be simplified. Moreover, since the waste liquid introducing member 33 is connected to the waste liquid container cover 64 which covers a portion of the opening of the storing concave portion 62, compared to the case where the waste liquid introducing member is connected to the side surface side of the waste liquid container 31, the waste liquid can be introduced into the storing concave portion 62 with high efficiency due to the gravity.

(38) Since the waste liquid container 31 is connected to the waste liquid introducing member 33 due to the fact that the notch 65 of the waste liquid container cover 64 is fitted to the fitting portion 59 which protrudes upward from the top plate 56, the gap which is generated between the waste liquid container cover 64 and the waste liquid introducing member 33 is eliminated, and leakage of the waste liquid can be suppressed.

In addition, the embodiment may be modified as described below.

Figure 13:
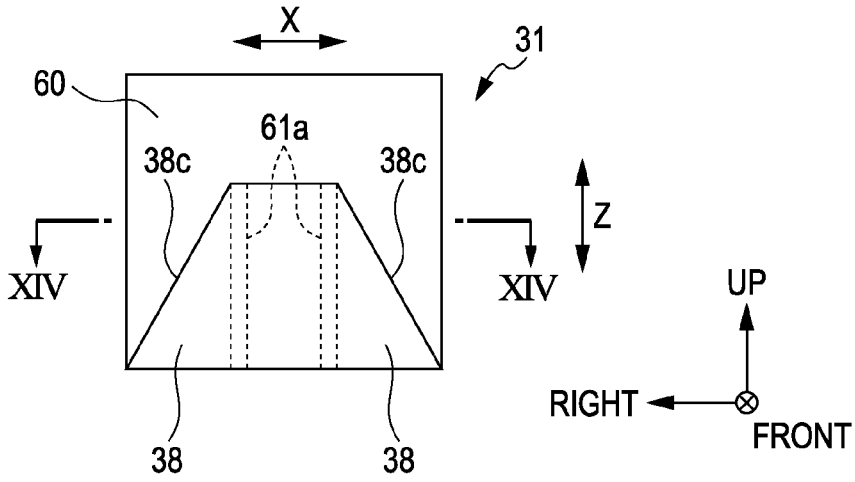
FIG. 13 is a rear view showing a first modification of a gripping portion which is provided in the waste liquid container.
Figure 14:
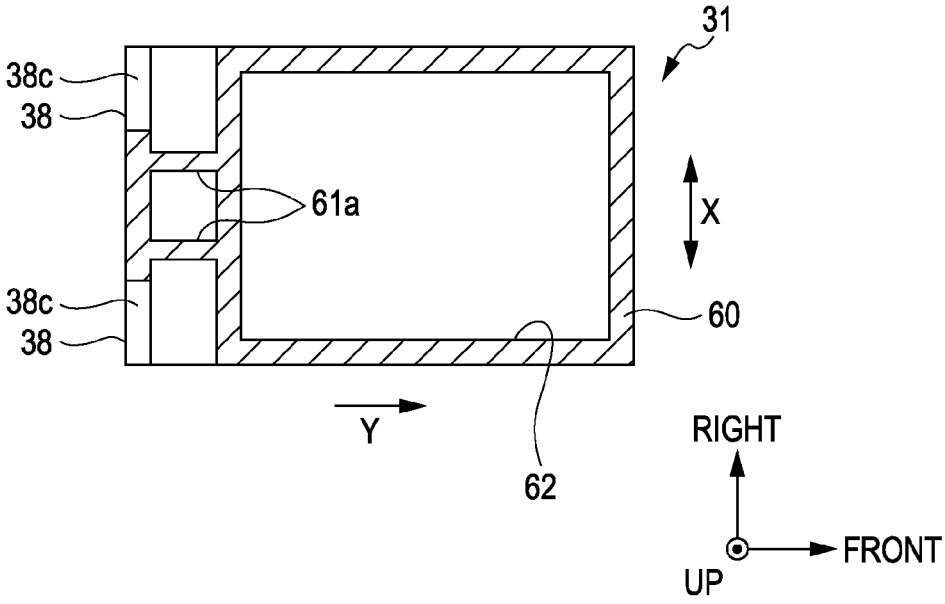
FIG. 14 is a cross-sectional view taken along a line XIV-XIV in FIG. 13.

The gripping portion 38 of the waste liquid container 31 may be modified like the first to tenth modifications described below. For example, as the first modification shown in FIGS. 13 and 14, the gripping portions 38 extend in two directions (the left direction the right direction) along a horizontal direction from the base portion 61*a*, and inclined portions 38*c*, which extend obliquely toward the side surface side from the upper end side or the lower end side of the waste liquid storing portion 60, may be provided in the tip side in the extended direction of the gripping portions 38. In addition, in the embodiment or in each modification, the case referred to as "along the horizontal direction" need not necessarily be exactly horizontal, and may be a roughly lateral direction. That is, if the shape of the gripping portion 38 is suitable so that the palm of the hand of a user does not face the up direction or the down direction but faces the lateral direction and grips the gripping portion, the extended direction from the base portion 61*a* may not necessarily be exactly horizontal. In addition, also similar to the horizontal direction in which the horizontal hole 72 which communicates with the vertical hole 71 provided in the absorption member 70 extends, the extended direction may not be an exact horizontal direction if crossing the up and down directions.

In addition, in the first modification, the base portion 61*a* and the inclined portion 38*c* may extend from the lower end of the waste liquid storing portion 60 to the upper end thereof. Moreover, in a second modification, the inclined portion 38*c* is provided in the tip side in the extended direction of the gripping portion 38. Therefore, even in a case where the length in the up and down directions Z of the waste liquid storing portion 60 or the gripping portion 38 is not sufficient so as to cause the palm of the hand to be an exact lateral direction, or the like, the length of the gripping portion 38 can be secured.

Figure 15:
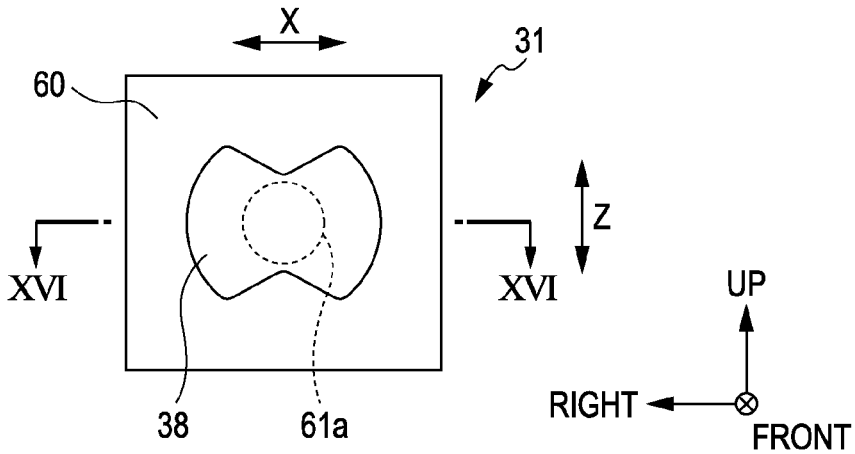
FIG. 15 is a rear view showing a second modification of the gripping portion which is provided in the waste liquid container.
Figure 16:
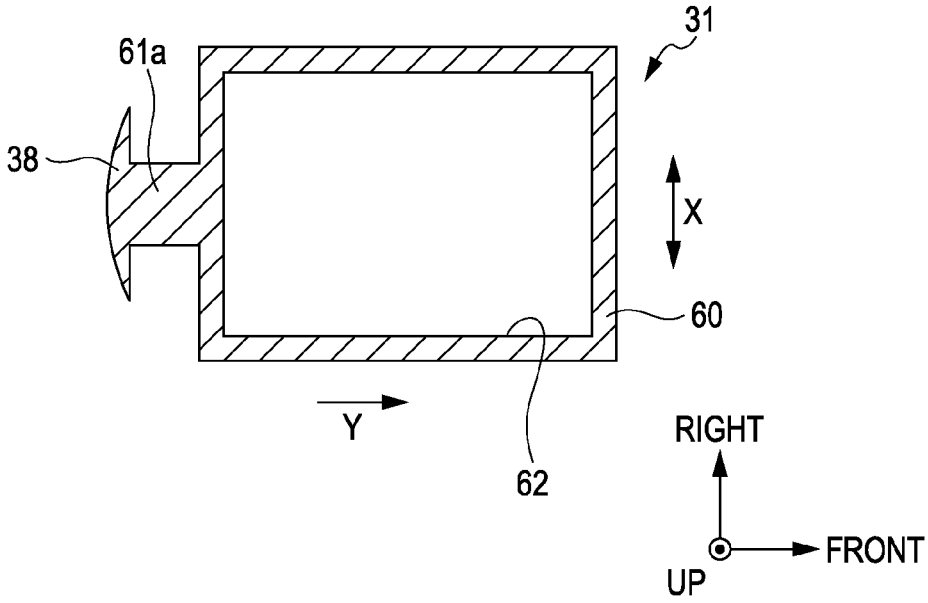
FIG. 16 is a cross-sectional view taken along a line XVI-XVI in FIG. 15.

Moreover, like the second modification shown in FIGS. 15 and 16, the base portion 61*a* or the gripping portion 38 may be modified to a shape other than the plate shape, and the gripping portion 38 may include portions which extend in directions other than the horizontal direction.

Figure 17:
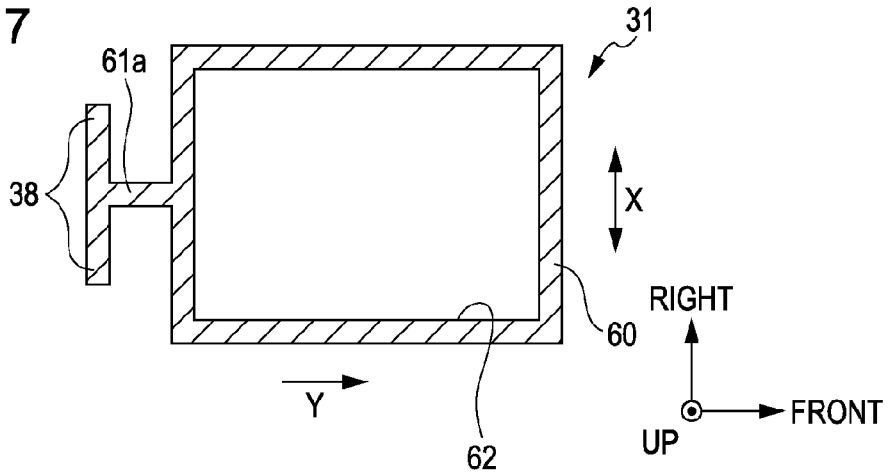
FIG. 17 is a cross-sectional view showing a third modification of the gripping portion which is provided in the waste liquid container.

In addition, like a third modification shown in FIG. 17, the gripping portion 38 may extend in two directions along a horizontal direction from a single base portion 61*a*. In this way, the number of installations of the base portions 61*a* may be arbitrarily modified.

Figure 18:
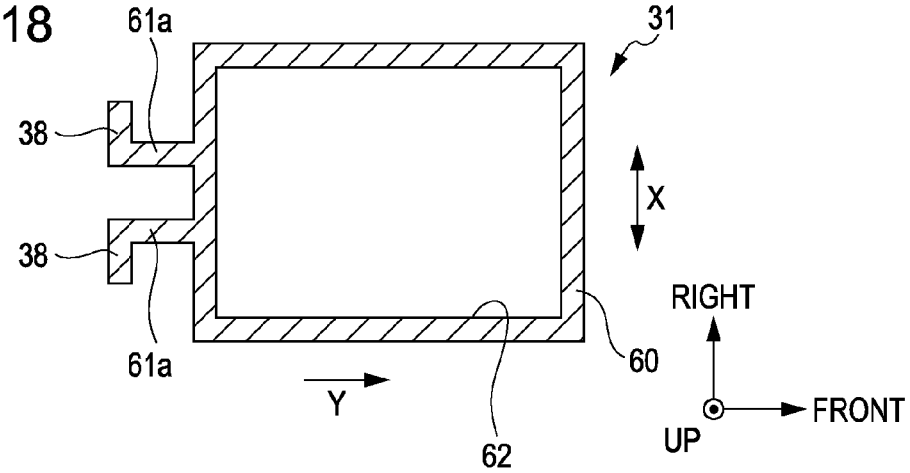
FIG. 18 is a cross-sectional view showing a fourth modification of the gripping portion which is provided in the waste liquid container.
Figure 19:
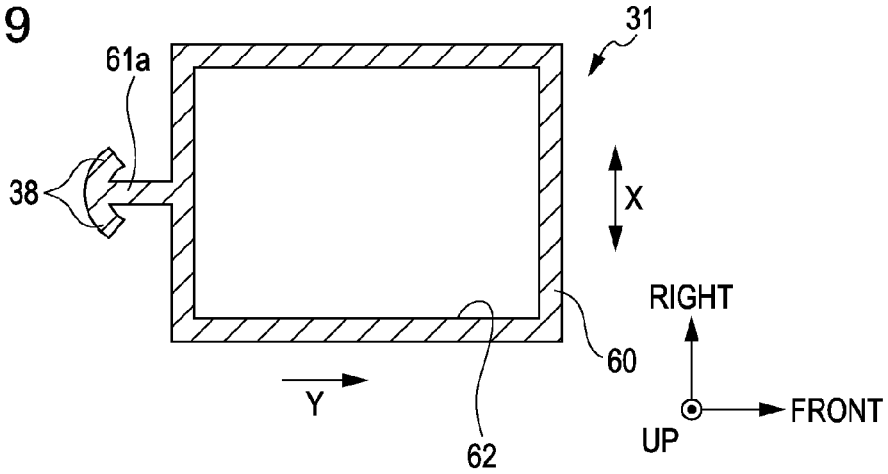
FIG. 19 is a cross-sectional view showing a fifth modification of the gripping portion which is provided in the waste liquid container.

In addition, like a fourth modification shown in FIG. 18, the gripping portions 38 may each extend toward the directions opposite to each other from two base portions 61*a*. Moreover, like a fifth modification shown in FIG. 19, the gripping portion 38 having an arc shape in cross-sectional view may extend in two directions from a single plate-like base portion 61*a*.

In addition, in the first to fifth modifications, the gripping portion 38 extends in two directions along the horizontal direction from the base portion 61*a*. Therefore, a user can easily grip the gripping portion 38 with either of the right hand or the left hand.

Figure 20:
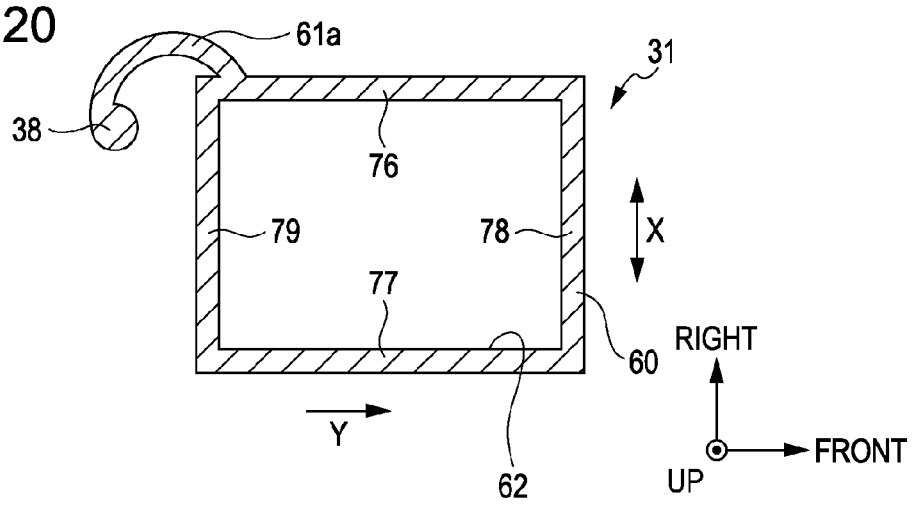
FIG. 20 is a cross-sectional view showing a sixth modification of the gripping portion which is provided in the waste liquid container.

In addition, like a sixth modification shown in FIG. 20, the base portion 61*a* may be modified so as to extend from the side walls (for example, first wall portion 76 or second wall portion 77) other than the fourth wall portion 79.

Figure 21:
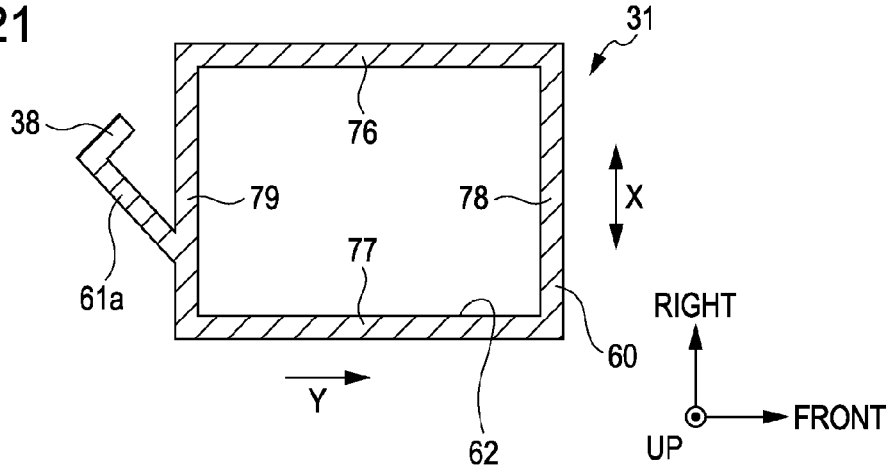
FIG. 21 is a cross-sectional view showing a seventh modification of the gripping portion which is provided in the waste liquid container.

Moreover, like a seventh modification shown in FIG. 21, an angle in which the plate-like base portion 61*a* crosses the fourth wall portion 79 or an angle in which the gripping portion 38 crosses the base portion 61*a* may be modified to any angle other than 90°.

Figure 22:
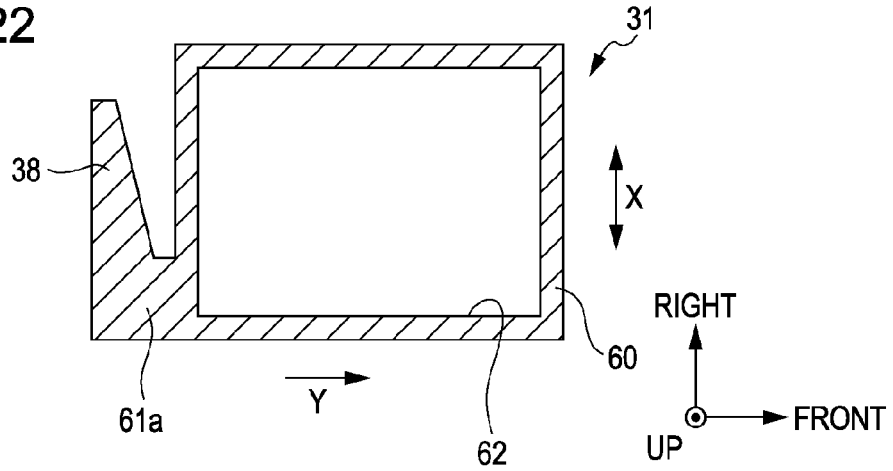
FIG. 22 is a cross-sectional view showing an eighth modification of the gripping portion which is provided in the waste liquid container.

In addition, like an eighth modification shown in FIG. 22, the cross-sectional area of the gripping portion 38 which is cut at the surface perpendicular to the insertion direction Y may be modified so to be changed. Moreover, in the seventh and eighth modifications, a user can easily grip the gripping portion 38 with the left hand.

Figure 23:
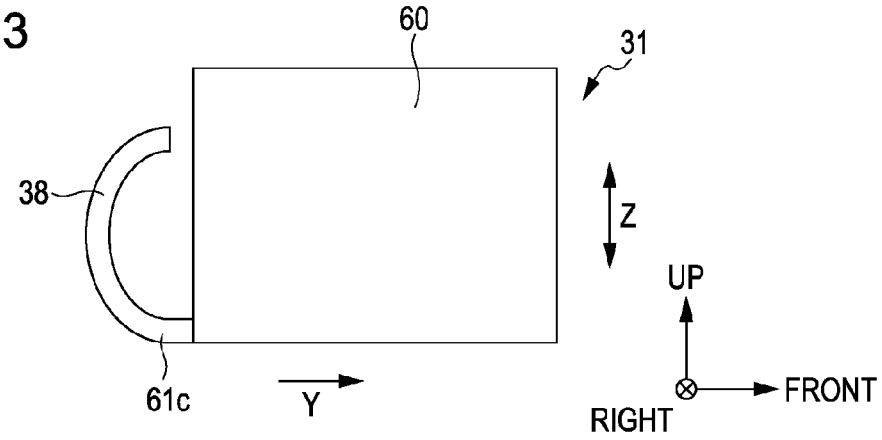
FIG. 23 is a cross-sectional view showing a ninth modification of the gripping portion which is provided in the waste liquid container.

In addition, like a ninth modification shown in FIG. 23, the gripping portion 38, which has an arc shape in side view upward from the base portion 61*c* without the base portions 61*a* and 61*b*, may be modified so as to extend so that the up and down directions Z are the longitudinal direction. Moreover, in the ninth modification, the gripping portion 38 may be modified so as to extend so that the up and down directions Z are the longitudinal direction downward from the base portion 61*b* extending from the upper end side of the waste liquid storing portion 60.

Figure 24:
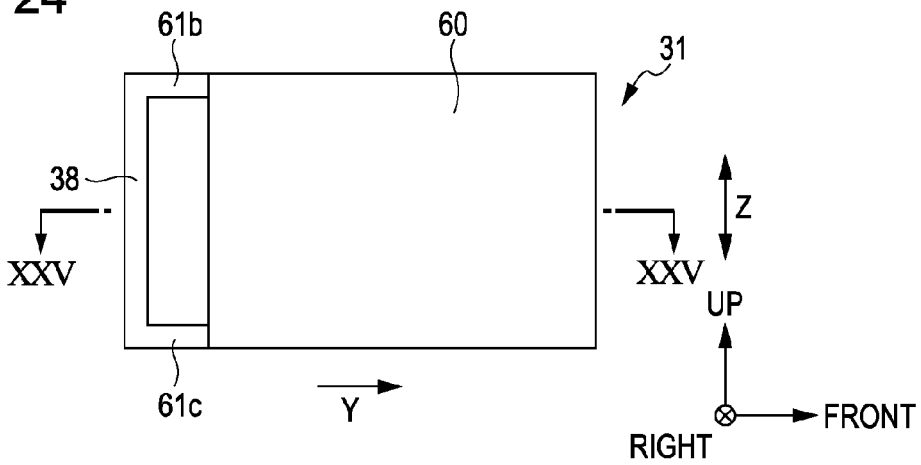
FIG. 24 is a cross-sectional view showing a tenth modification of the gripping portion which is provided in the waste liquid container.
Figure 25:
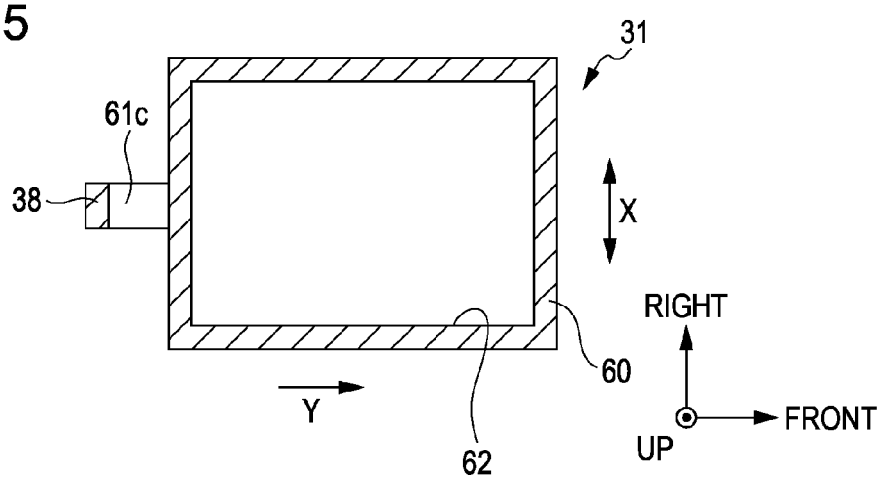
FIG. 25 is a cross-sectional view taken along a line XXV-XXV in FIG. 24.

In addition, like a tenth modification shown in FIGS. 24 and 25, the gripping portion 38 may be modified so as to extend so that the up and down directions Z from the base portions 61*b* and 61*c* are the longitudinal direction. Moreover, in the ninth and tenth modifications, a user can easily grip the gripping portion 38 with either of the right hand and the left hand, and the attaching and the detaching of the waste liquid container 31 can be performed in the state where the gripping portion 38 is gripped.

The front side portion of the rear surface cover 35 may configure the transport path forming member 43 and support members such as the sheet feeding roller 41. In addition, a driven roller or the like which assists the transport of the sheets P may be supported to the rear surface cover 35.

The rear surface cover 35 may be configured so as to open and close the mounting opening 37 by rotating the rear surface cover around one end side (for example, lower end side), and may be configured so as to open and close the mounting opening 37 by attaching and detaching the rear surface cover.

The rear surface cover 35 may cover the entire opening of the mounting opening 37, and the rear surface cover 35 may cover a portion of the upper end side, the lower end side, or the right end side of the mounting opening 37.

The mounting opening 37 may be provided on the front surface or the side surface of the recording portion case 14.

A groove-shaped engagement portion which extends along the insertion direction Y may be provided in the waste liquid container 31, and the groove-shaped engagement portion and the guide portion 52 of the waste liquid container mounting portion 32 may be engaged with each other. Moreover, the engagement portion of the waste liquid container 31 may be provided on the bottom surface side or the upper surface side of the waste liquid storing portion 60.

The positioning rib 67 may not protrude from the lower end portion of the waste liquid storing portion 60 but protrude in a horizontal direction from the wall surface (for example, first wall portion 76 or the like) of the side wall.

Those other than the bottom surface portion 49 of the waste liquid container mounting portion 32 may be used as the regulation portion in the downward direction of the positioning rib 67. For example, a protrusion which is formed so as to protrude upward from the bottom surface portion 49 of the waste liquid container mounting portion 32, an apparatus bottom surface of the multifunction machine 11, or the like may be used.

The waste liquid container 31 may not include the stopper portion 67*a*.

The waste liquid container 31 may not include the reinforcement rib 80 or the regulation rib 81.

The biasing member for positioning may be modified to a biasing member such as a coil or rubber member other than the plate spring 54.

The biasing force receiving portion may be modified to a concave portion which is engaged with the bending portion 54*b* of the plate spring 54.

In a case of a configuration in which the container side connection terminal 69 and the device side connection terminal 53 contact each other in the state of being lined up in the up and down directions Z, the biasing force receiving portion and the biasing member for positioning may be disposed so as to line up in the up and down directions Z.

In the waste liquid introducing member 33, the length which protrudes downward from the annular protrusion 58 in the lower surface side of the top plate portion 56 may be longer than the length which protrudes downward from the introduction pipe portion 57. According to this configuration, it is possible to suppress the waste liquid which is discharged from the introduction pipe portion 57 from being scattered to the waste liquid container cover 64 side.

In the waste liquid introducing member 33, the lower end of the annular protrusion 58 may be inserted into the vertical hole 71 of the absorption member 70. According to this configuration, the waste liquid which flows along the annular protrusion 58 can be reliably introduced into the vertical hole 71.

A plurality of plate-like absorption members 70 may be laminated in the up and down directions Z and be accommodated in the storing concave portion 62.

In a case where the waste liquid is introduced to a single waste liquid container 31 through a plurality of introduction pipe portions 57, or the like, the absorption member 70 may include a plurality of vertical holes 71.

The absorption member 70 may include two horizontal holes 72 which each extend in the insertion direction Y and the main scanning direction X. In addition, the size, the length, the shape, the disposition, the number installed, or the like of the vertical holes 71 and the horizontal holes 72 may be arbitrarily modified according to the shape of the storing concave portion 62, the properties of the waste liquid, or the like.

The detection sensor 46 may not be present. For example, in a case where the waste liquid container 31 can be exchanged without stopping the recording processing or stopping the transport processing of the sheets P, the detection sensor 46 is not required. Moreover, in a case where the waste liquid container 31 is exchanged after a user stops the driving of the recording portion 12 and the transport device 40, the detection sensor 46 is not required.

The recording portion 12 may be an on-carriage type in which the ink cartridge 27 is mounted on the carriage 24. Alternatively, the invention is not limited to a serial type printer in which the carriage 24 moves in the main scanning direction X. That is, the invention may include a line head type printer or a lateral type printer in which a printing in a maximum width range of the sheet can be performed in the state where the liquid ejecting head 25 is fixed. Moreover, an ink jet type label printer, a bar code printer, a ticketing system, or the like may be applied to the invention.

The liquid ejecting apparatus may be a printer which does not include an image reading portion 13 and may be a multifunction machine which includes functions such as a facsimile device or a copier together with the recording portion 12. However, the apparatuses in which liquid other than ink is ejected or discharged may be applied, and the invention may be applied to various liquid ejecting apparatuses including a liquid ejection head, and the like, which discharge minutely small liquid droplets. Further, the liquid droplet designates a liquid state discharged from the liquid ejecting apparatus, and may include granular, tear-shaped, or threadlike trailed droplets. Also, the liquid in this invention may be any material ejected from the liquid ejecting apparatus. For example, it is preferable if the material is a liquid phase, however, examples of the liquid may additionally include high or low viscosity liquid states, sols, aqueous water, other inorganic solvents, organic solvents, solutions, liquid resins, liquids in a flowable condition such as liquid metal (molten metal) or a state of material, and particles of functional materials, which are dissolved, distributed or mixed, consisting of a solid material such as pigments or metal particles, and the like. Further, as described in the embodiments, ink, a liquid crystal, or the like is mentioned as a representative example of the liquid. Here, inks include general water-based inks and oil-based inks, various fluid compositions such as gel inks, hot melt inks, and the like. For example, specific example of the liquid ejecting apparatus of the invention may include a liquid ejecting apparatus for ejecting liquid including materials such as electrode materials or color materials, which are used for manufacturing a liquid crystal display, EL (electroluminescence) display, a surface light emitting display, a color filter, and the like, as a distributed or dissolved form. In addition, the liquid ejecting apparatus of the invention may include a liquid ejecting apparatus for ejecting bioorganic materials used in the manufacture of biochips, a liquid ejecting apparatus for ejecting liquid including samples used as a precision pipette, an apparatus for printing clothes, a micro-dispenser, or the like. Moreover, the liquid ejecting apparatus of the invention may include a liquid ejecting apparatus for ejecting lubricating oil in precision machines such as watches or cameras by a pin point; a fluid ejecting apparatus for ejecting transparent resins such as an ultraviolet-curable resin for forming micro-hemispherical lens (optical lens) used in optical communication elements or the like on a substrate; and a liquid ejecting apparatus for ejecting etching solutions such as an acid or an alkali for etching substrates or the like.

The waste liquid container of the invention may be a container which collects a mist which is scattered according to the ejection of liquid or the like and stores the liquefied waste liquid, and may be a container which stores liquids having various functions which are used for cleaning the liquid ejecting head or the like as well as the liquid which is used in the ejection with respect to the target. In addition, for example, in apparatuses other than the liquid ejecting apparatus, the waste liquid container may be a container which stores an arbitrary waste liquid such as a spent test liquid, reagent, or the like which is used for inspection or the like.

The liquid consumption apparatus of the invention is not limited to the liquid ejecting apparatus which consumes liquid by ejecting the liquid, and may be a cleaning apparatus which consumes a cleaning solution according to the cleaning of an object and discharges the used cleaning solution as the waste liquid, a liquid circulation apparatus which discharges a portion of a circulating liquid which is circulated a predetermined number of times as the waste liquid for the exchange or the like, or the like.

What is claimed is:

1. A waste liquid container which is detachably mounted on a waste liquid container mounting portion including a device side connection terminal and a biasing member for positioning, comprising:

a waste liquid storing chamber which stores waste liquid;

a first wall portion and a second wall portion which are disposed so as to face each other with the waste liquid storing chamber interposed therebetween;

a container side connection terminal which is provided on an outer surface of the second wall portion and contacts the device side connection terminal at the time of being mounted on the waste liquid container mounting portion; and a biasing force receiving portion which is provided on the first wall portion so as to receive a biasing force of the biasing member for positioning which is applied from the first wall portion side toward the second wall portion side, wherein the biasing force receiving portion is a positioning protrusion which protrudes in a horizontal direction from an outer surface of the first wall portion.

2. The waste liquid container according to claim 1, wherein the first wall portion and the second wall portion are side walls which extend along an insertion direction of the waste liquid container with respect to the waste liquid container mounting portion.

3. A liquid consumption apparatus comprising:

a liquid consumption portion which consumes liquid;

the waste liquid container according to claim 2;

a waste container mounting portion on which the waste liquid container is detachably mounted;

a device side connection terminal which is provided in the waste liquid container mounting portion so as to contact the container side connection terminal when the waste liquid container is mounted; and a biasing member for positioning which is provided in the waste liquid container mounting portion so that the waste liquid container is biased toward the device side connection terminal side when the waste liquid container is mounted.

4. A liquid consumption apparatus comprising:

a liquid consumption portion which consumes liquid;

the waste liquid container according to claim 1;

a waste container mounting portion on which the waste liquid container is detachably mounted;

a device side connection terminal which is provided in the waste liquid container mounting portion so as to contact the container side connection terminal when the waste liquid container is mounted; and a biasing member for positioning which is provided in the waste liquid container mounting portion so that the waste liquid container is biased toward the device side connection terminal side when the waste liquid container is mounted.

5. The waste liquid container according to claim 1, wherein the biasing member for positioning is a plate spring which includes an extended portion extended along the insertion direction and a bending portion which is bent toward the device side connection terminal side in a tip side of the extended portion, and the positioning protrusion includes a first side surface and a second side surface which extend from the first wall portion toward an apex in the protrusion direction, and the second side surface which is positioned in the front side in the insertion direction is engaged with the bending portion of the biasing member for positioning at the time of being mounted on the waste liquid container mounting portion.

6. A liquid consumption apparatus comprising:

a liquid consumption portion which consumes liquid;

the waste liquid container according to claim 5;

a waste container mounting portion on which the waste liquid container is detachably mounted;

a device side connection terminal which is provided in the waste liquid container mounting portion so as to contact the container side connection terminal when the waste liquid container is mounted; and a biasing member for positioning which is provided in the waste liquid container mounting portion so that the waste liquid container is biased toward the device side connection terminal side when the waste liquid container is mounted.

7. The waste liquid container according to claim 5, wherein the waste liquid storing chamber is formed so as to be enclosed by a storing concave portion which has an upper opening and a waste liquid container cover which covers the opening, and the biasing force receiving portion is disposed below the first wall portion in the up and down directions.

8. A liquid consumption apparatus comprising:

a liquid consumption portion which consumes liquid;

the waste liquid container according to claim 7;

a waste container mounting portion on which the waste liquid container is detachably mounted;

a device side connection terminal which is provided in the waste liquid container mounting portion so as to contact the container side connection terminal when the waste liquid container is mounted; and a biasing member for positioning which is provided in the waste liquid container mounting portion so that the waste liquid container is biased toward the device side connection terminal side when the waste liquid container is mounted.

9. The waste liquid container according to claim 7, wherein the container side connection terminal and the biasing force receiving portion are disposed so as to line up along a width direction which crosses the insertion direction with respect to the waste liquid container mounting portion.

10. A liquid consumption apparatus comprising:

a liquid consumption portion which consumes liquid;

the waste liquid container according to claim 9;

a waste container mounting portion on which the waste liquid container is detachably mounted;

a device side connection terminal which is provided in the waste liquid container mounting portion so as to contact the container side connection terminal when the waste liquid container is mounted; and a biasing member for positioning which is provided in the waste liquid container mounting portion so that the waste liquid container is biased toward the device side connection terminal side when the waste liquid container is mounted.

11. The waste liquid container according to claim 9, wherein a reinforcement rib protrudes toward the second wall portion side from a position corresponding to the biasing force receiving portion in the inner surface of the first wall portion.

12. A liquid consumption apparatus comprising:

a liquid consumption portion which consumes liquid;

the waste liquid container according to claim 11;

a waste container mounting portion on which the waste liquid container is detachably mounted;

a device side connection terminal which is provided in the waste liquid container mounting portion so as to contact the container side connection terminal when the waste liquid container is mounted; and a biasing member for positioning which is provided in the waste liquid container mounting portion so that the waste liquid container is biased toward the device side connection terminal side when the waste liquid container is mounted.

* * * * *